US006634928B2

(12) United States Patent
Erickson et al.

(10) Patent No.: US 6,634,928 B2
(45) Date of Patent: Oct. 21, 2003

(54) FLUID JET CUTTING METHOD AND APPARATUS

(75) Inventors: Karl Robert Erickson, Rochester, MN (US); Dennis L. Fox, Rochester, MN (US); Douglas Allen Kuchta, Rochester, MN (US); Douglas Howard Piltingsrud, Eyota, MN (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 10/040,516

(22) Filed: Nov. 9, 2001

(65) Prior Publication Data

US 2003/0092361 A1 May 15, 2003

(51) Int. Cl.[7] ..... B24C 3/04

(52) U.S. Cl. ..... 451/40; 451/38; 451/39; 451/78; 83/177

(58) Field of Search ..... 451/38–40, 78; 83/177, 53, 451; 125/12

(56) References Cited

U.S. PATENT DOCUMENTS 3,877,334 A * 4/1975 Gerber ..... 83/22
4,463,639 A * 8/1984 Gerber ..... 83/72
4,656,791 A 4/1987 Herrington et al.
4,702,042 A 10/1987 Herrington et al.
4,711,056 A 12/1987 Herrington et al.
4,937,985 A 7/1990 Boers et al.
5,003,729 A * 4/1991 Sherby ..... 451/38
5,020,724 A 6/1991 Kiyono et al.
5,083,487 A * 1/1992 Croteau ..... 83/29
5,208,795 A 5/1993 Lavinsky et al.
5,258,917 A 11/1993 Bruder et al.
5,273,405 A 12/1993 Chalmers et al.
5,318,005 A * 6/1994 Mayer ..... 125/13.01
5,363,556 A 11/1994 Banholzer et al.
5,363,603 A 11/1994 Miller et al.
5,831,224 A * 11/1998 Wattles et al. ..... 181/233
5,851,139 A 12/1998 Xu
6,012,653 A 1/2000 Gunther et al.
6,066,018 A * 5/2000 Grupp et al. ..... 445/25
6,095,025 A 8/2000 Mirabello
6,098,512 A * 8/2000 Life et al. ..... 83/53
6,155,245 A * 12/2000 Zanzuri ..... 125/12
6,200,203 B1 3/2001 Xu et al.

* cited by examiner

*Primary Examiner*—George Nguyen

(57) ABSTRACT

A fluid jet cutting method and apparatus for cutting an object from a sheet. In one embodiment, a fluid jet stream is directed against a glass sheet to cut an annular disk substrate for use in a data storage device. The sheet is supported by first, second and third support members. The support surfaces of the second and third support members are respectively positioned inside central openings in the first and second support members. A vacuum pulls the sheet against the support surface of at least the second support member. Preferably, plural central openings in the first support member accommodate plural second and third support members, whereby plural substrates are cut from the sheet. The sheet preferably includes plural layers removably adhered to one another, whereby plural substrates are simultaneously formed by a single fluid jet stream. A protective layer may cover at least one surface to the sheet.

41 Claims, 11 Drawing Sheets

FLUID JET CUTTING METHOD AND APPARATUS

CROSS-REFERENCE TO RELATED APPLICATION

This patent application is related to Ser. No. 10/035,590, filed concurrently, entitled "ABRASIVE FLUID JET CUTTING COMPOSITION, METHOD AND APPARATUS", which is assigned to the assignee of the instant application.

FIELD OF THE INVENTION

The present invention relates in general to cutting an object from a sheet using a fluid jet stream. More particularly, the present invention relates to supporting the sheet (e.g., a glass or ceramic sheet) while the object (e.g., an annular disk substrate for use in a data storage device) is cut from the sheet.

BACKGROUND

A typical disk drive data storage system includes one or more data storage disks for storing data, typically in magnetic, magneto-optical or optical form, and a transducer used to write and read data respectively to and from the data storage disk. The data storage disks are typically coaxially mounted on a hub of a spindle motor. The spindle motor rotates the data storage disks at speeds typically on the order of several thousand or more revolutions-per-minute. Digital information, representing various types of data, is typically written to and read from the data storage disks by one or more transducers, or read/write heads, which are mounted to an actuator assembly and passed over the surface of the rapidly rotating disks.

In a typical magnetic disk drive, for example, data is stored on a magnetic layer coated on a disk substrate. The disk substrate is typically aluminum-based (e.g., aluminum magnesium alloy coated with NiP), glass (e.g., aluminosilicate glass), ceramic (e.g., alumina, silicon carbide or boron carbide), or composite (e.g., aluminum boron carbide composite).

Typically, the glass or glass-ceramic disk substrate is made by traditional machining techniques. One such technique is the mechanical scribe and break method, followed by edge grinding. These traditional machining techniques require costly, high precision tooling to make the exact dimensions of a disk substrate. In addition to being costly, these traditional machining techniques form an edge on the disk substrate that requires a subsequent edge polishing process. That is, the brittle fracture created by these traditional machining techniques must be polished out of the edge surfaces of the disk substrate. Damaged edges result in disk substrates having weakened structural integrity.

A non-traditional technique for making the glass or glass-ceramic disk substrate is the laser scribe and break method. Initially, during a laser scribe step, a blank from which the disk substrate is to be formed is scribed by a laser. Then, during a thermal breakout step, the blank is heated and a crack is initiated along the scribe line. This method produces a disk substrate having a very clean edge with right angle corners. However, the laser scribe and break method has several disadvantages. For example, the method is inherently slow due to its sequential two step nature and because only one part may be machined at a time. In order to equal the output of traditional machining techniques, the laser scribe and break method requires many systems operating in parallel. This increases costs. Another disadvantage relates to the right angle corners produced by the laser scribe and break method. These corners may need to be rounded or at least chamfered. Thus, the pristine edge may require subsequent processing that potentially negates its edge finish. Yet another disadvantage of the laser scribe and break method is that the laser must be tuned for each formulation of the disk substrate. In some cases this may require replacement lasers that have different operating wavelengths, thereby increasing cost and delay.

Yet another disadvantage of the laser scribe and break method is the nub created at the crack initiation point. An extra edge polishing process is required to remove this nub.

There exists in the data storage system manufacturing industry a keenly felt need to provide an enhanced machining technique for making disk substrates. There exists a further need to provide such an enhanced machining technique for making disk substrates that permits improvement in production cycle times, costs and/or disk substrate quality.

SUMMARY OF THE INVENTION

An object of the present invention is to provide an enhanced machining technique.

Another object of the present invention is to provide an enhanced machining technique for making a disk substrate.

Yet another object of the present invention is to provide an enhanced machining technique for making a disk substrate that permits improvement in production cycle times, costs and/or disk substrate quality.

These and other objects of the present invention are achieved by a fluid jet cutting method and apparatus for cutting an object from a sheet. In an exemplary embodiment, a fluid jet stream is directed against a glass sheet to cut an annular disk substrate for use in a data storage device. The sheet is supported by first, second and third support members. The support surfaces of the second and third support members are respectively positioned inside central openings in the first and second support members. A vacuum pulls the sheet against the support surface of at least the second support member.

Preferably, a plurality of central openings in the first support member accommodate a plurality of second and third support members, whereby a plurality annular disk substrates are cut from the sheet. This permits improvement in production cycle times and costs. For example, a plurality of fluid jet streams may directed against the sheet to simultaneously cut a plurality of annular disk substrates.

The sheet preferably includes a plurality of layers removably adhered to one another, whereby a plurality of annular disk substrates are simultaneously formed by a single fluid jet stream. This arrangement permits improvement in production cycle times and costs.

A protective layer may cover a portion of at least one surface to the sheet. This permits improvement in disk substrate quality. For example, the protective layer may be used to protect the surface of the annular disk substrate adjacent to the cut from being damaged by overspray of the fluid jet stream and chipout caused as the fluid jet stream exits the sheet.

BRIEF DESCRIPTION OF THE DRAWINGS

The present invention together with the above and other objects and advantages can best be understood from the following detailed description of the embodiments of the invention illustrated in the drawings, wherein like reference numerals denote like elements.

DETAILED DESCRIPTION OF THE PREFERRED EMBODIMENTS

Figure 1:
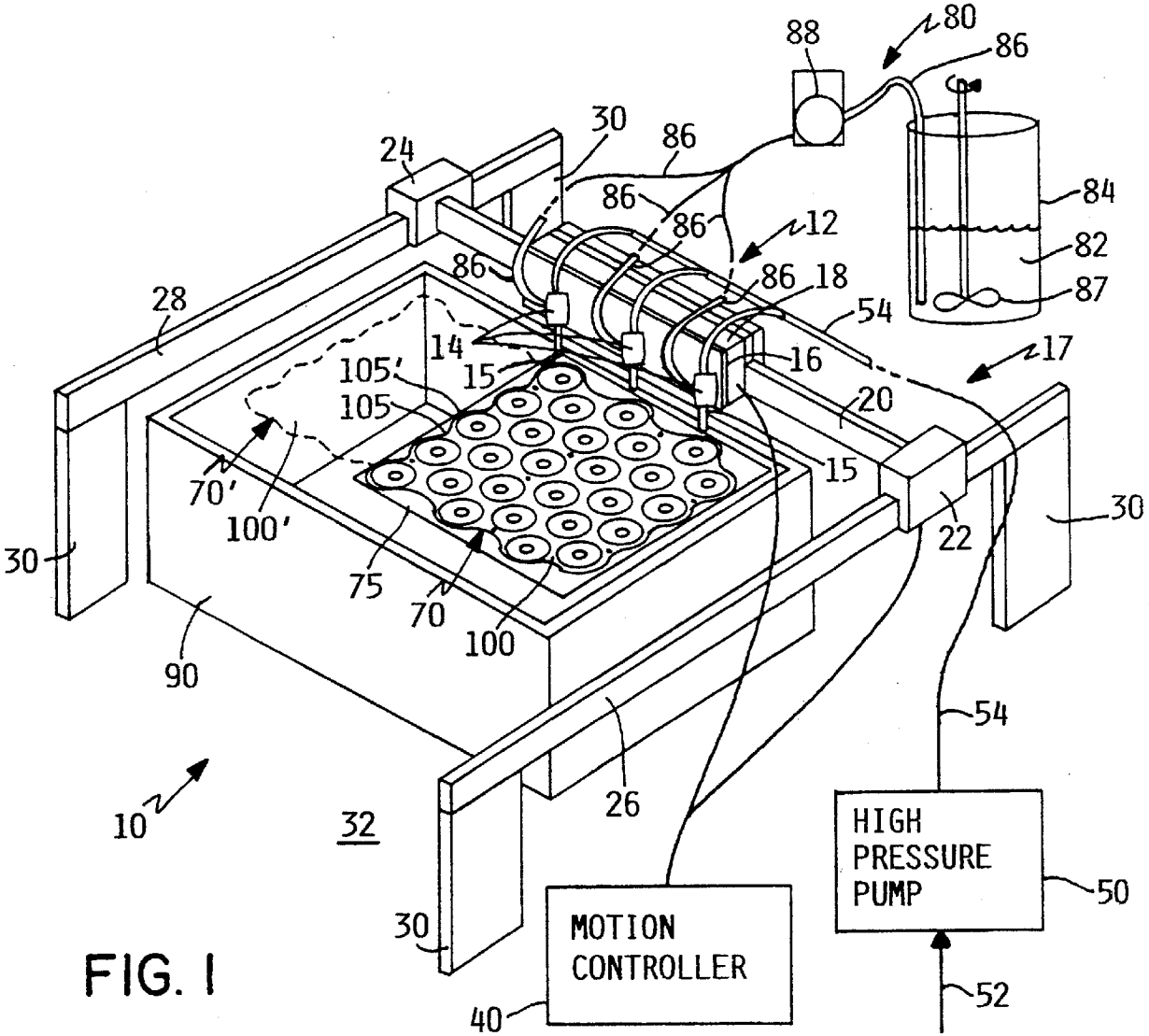
FIG. 1 is a schematic perspective view of a fluid jet cutting apparatus according to an embodiment of the present invention.

Referring to FIG. 1, there is shown a fluid jet cutting system 10 according to one embodiment of the present invention. The fluid jet cutting system 10 includes a fluid jet cutting head assembly 12, which includes three identical fluid jet heads 14 each having a nozzle 15 and fixedly mounted on a common spreader bar 16. The use of multiple fluid jet heads 14 dramatically improves production cycle times, since multiple objects can be cut simultaneously. Of course, any number of the fluid jet heads 14 may be mounted on the spreader bar 16 in lieu of the three shown in FIG. 1. Likewise, the single spreader bar 16 shown in FIG. 1 may be replaced by any number of the spreader bars 16, each having at least one fluid jet head mounted thereon. Also, the spreader bar 16 may have a different orientation than the longitudinal orientation shown in FIG. 1. For example, the spreader bar 16 may be reoriented in a lateral direction or a diagonal direction.

The fluid jet cutting system 10 also includes a motion control system 17 for moving the spacer bar 16 and hence the fluid jet heads 14. The motion control system 17 is shown in FIG. 1 for the purpose of illustration, not limitation. Numerous motion control systems are commercially available, including 2, 3 and 5-axis XY gantries and multi-axis robotic installations, that may be used in lieu of the example shown in FIG. 1. An example of such a commercially available motion control system that may be used is the Allen-Bradley 9/Series CNC (computer numerical control), available from Rockwell Automation, Milwaukee, Wisconsin. The motion control system 17 shown in FIG. 1 includes a carriage 18, a transverse track 20, carriages 22 and 24, parallel tracks 26 and 28, legs 30 and a motion controller 40. The spacer bar 16 is fixedly mounted to the carriage 18, which moves along the transverse track 20. The two ends of the transverse track 20 are respectively fixedly mounted to carriages 22 and 24. Carriages 22 and 24 respectively move along parallel tracks 26 and 28, which are supported by legs 30 on floor 32.

The motion controller 40 guides the cutting motion of the fluid jet heads 14 by controlling the movement of carriages 18, 22 and 24 along tracks 20, 26 and 28. Accordingly, the motion controller 40 guides the cutting motion of the fluid jet heads 14 in any direction longitudinally, laterally or diagonally. Because the fluid jet heads 14 are fixedly mounted to the same spreader bar 16 they follow the same path over different portions of a support assembly 70 that underlie the fluid jet heads 14. The support assembly 70, which is discussed in greater detail below, supports a sheet 75 from which an object is to be cut. The object to be cut may be, for example, an annular disk substrate which is to be cut from a glass sheet. The cutting path followed by each of the fluid jet heads 14 generally corresponds to the shape of the object. Once the object is cut, the fluid jet head 14 moves along a transit path to a different area of sheet 75 to cut another object. For example, the fluid jet heads 14 may be moved over a first area of sheet 75, activated to cut a first row of objects, deactivated, moved to a different area of sheet 75, activated to cut a second row of objects, and deactivated. This process would be repeated until each row of objects has been cut. The use of multiple fluid jet heads 14 dramatically improves production cycle times, since multiple objects can be cut simultaneously.

The motion controller 40 is preferably a computer that is programmed to control the motion of carriages 18, 22 and 24, and hence the motion of the fluid jet heads 14, in accordance with the shape of object to be cut from the sheet 75, the arrangement of multiple objects to be cut from the sheet 75, and the cutting sequence. With regard to the first factor, each of the fluid jet heads 14 moves along a cutting path that generally corresponds to the shape of the object. As in conventional, the cutting path typically includes a lead in so that the cut is begun away from the object to be cut and a lead out so that the cut is ended away form the object just cut. With regard to the second factor, i.e., the arrangement of multiple objects to be cut from the sheet 75, each of fluid jet heads 14 moves along a path from one object to the next object. With regard to the third factor, i.e., the cutting sequence, each of the fluid jet heads 14 may move to a second object before completing a first object. For example, the fluid jet heads 14 may be moved to cut the central hole in each and every one of the annular disk substrates to be cut from the sheet 75 before any of the outside edges of the annular disk substrates are cut, or vice versa. Also, it may be desirable to move the fluid jet heads 14 to initially form pierce holes for each and every one of the objects to be cut from the sheet 75 because forming pierce holes using the fluid jet heads 14 often requires the fluid jet stream to be at a significantly lower pressure than that required for cutting.

The computer interacts with motors (not shown) and sensors (not shown) associated with carriages 18, 22 and 24.

Such motors and sensors and the computer numerical control (CNC) devices and techniques used to operate them are well known in the art, and thus not further described herein. Alternatively, the motion of the fluid jet heads 14 may be controlled using a template or cam-and-follower arrangement as are commonly used for repetitive cutting of a particular object. For example, an optical tracer mechanically connected to the spreader bar 16 may be used to trace a template of an object to be cut from the sheet 75 by the fluid jet heads 14.

As briefly mentioned above, the fluid jet cutting system 10 also includes a support assembly 70 for supporting a sheet 75 from which annular disk substrates are to be cut. Of course, the support assembly is not restricted to use in making annular disk substrates, but also may be used to cut other objects. As will be discussed in more detail below, the support assembly 70 includes three types of support members each having a support surface for supporting different portions of the sheet 75. Preferably, a vacuum pulls the sheet 75 against at least one of the support surfaces to prevent the sheet 75 from moving during the cutting operation. The support assembly 70 is preferably modular to support sheets of different sizes.

The fluid jet cutting system 10 also includes a high pressure pump 50 that receives a fluid from a fluid line 52 and outputs the fluid at high pressure (typically, greater than 10,000 PSI) through a high pressure line 54 to each of the fluid jet heads 14. Rather than using a single high pressure pump as shown in FIG. 1, each of the fluid jet heads 14 could respectively receive fluid at high pressure from a separate high pressure pump. In any event, the fluid is provided at high pressure to each of the fluid jet heads 14. The fluid enters the fluid jet head as a high velocity fluid stream. The fluid provided by the fluid line 52 is typically deionized, filtered water from a reservoir, for example. The high pressure pump 50 is conventional. For example, such high pressure pumps are commercially available from Jet Edge, a division of TC/American Monorail, Saint Michael, Minn. The high pressure pump 50 may, for example, use an intensifier to increase the pressure of fluid exiting a low pressure hydraulic pump to a high pressure, and an attenuator to smooth out pressure fluctuations from the intensifier.

The fluid jet heads 14 are also conventional. For example, such fluid jet heads are commercially available from Jet Edge, a division of TC/American Monorail, Saint Michael, Minn. The fluid jet heads 14 may, for example, include an internal mixing chamber for mixing the high velocity fluid stream from the high pressure line 54 and abrasive particles from an abrasive line. As is conventional, the fluid jet heads 14 may entrain a dry abrasive from an abrasive line into the high velocity fluid stream within the mixing chamber. As the high velocity fluid stream passes the mixing chamber, a vacuum is created that draws the dry abrasive into the stream. However, as discussed in more detail below, the fluid jet heads 14 preferably entrain an abrasive slurry, rather than a dry abrasive, into the high velocity fluid stream within the mixing chamber. The abrasive slurry improves the metering of fine abrasive particles that tend to have self cohesion and plug the abrasive line. Of course, the invention is not limited to using an abrasive in any form. For example, some materials and objects are best cut with a fluid jet stream that does not include abrasive particles.

The structure and operation of a typical conventional fluid jet head is discussed below for the purpose of illustration, not limitation. The high velocity fluid stream is typically introduced into the mixing chamber of the fluid jet head through an orifice having a small diameter bore (typically, 0.001–0.025 inch, 0.025–0.64 mm). The abrasive particles are typically introduced through a bore that is transverse to the orifice bore. The abrasive particles are mixed with the high velocity fluid stream in the mixing chamber of the fluid jet head and the mixture exits through a nozzle having a small diameter bore (typically, 0.0025–0.15 inch, 0.063–3.8mm) as an abrasive fluid jet stream. Typically the fluid jet head is constructed so that the nozzle bore is axially aligned with the orifice bore. During the cutting operation, the end of the nozzle from which the abrasive fluid jet stream exits is typically positioned relatively close to the sheet (typically, 0.025–0.250 inch, 0.64–6.35 mm). This is sometimes referred to as the "standoff distance."

The fluid jet cutting system 10 also includes an abrasive slurry delivery system 80. Each of the fluid jet heads 14 receives an abrasive slurry 82 from a slurry tank 84 through a slurry line 86. The abrasive slurry 82 is preferably stirred within the slurry tank 84 by a mixing device such as a rotating blade stirrer 87. The slurry line 86 preferably draws the abrasive slurry 82 from a location near the bottom of the slurry tank 84 near the rotating blade stirrer 87. A slurry pump 88 is preferably provided to pump the abrasive slurry 82 through the slurry line 86 in the direction toward the fluid jet heads 14. Preferably, the slurry pump 88 is of a peristaltic type and is positioned higher in elevation than the fluid jet heads 14 so that the abrasive slurry 82 can flow downward from the slurry pump 88 through the slurry line 86 to the fluid jet heads 14 by action of gravity, even after the slurry pump 88 is turned off. The peristaltic type slurry pump 88 is conventional. An example of such a peristaltic type slurry pump is the Masterflex™ controller model number 07553-71 and motor model number 07553-02 available from Cole-Parmer Instrument Company, Vernon Hills, Ill. The peristaltic type slurry pump 88 is shown for the purpose of illustration, not limitation. The peristaltic type slurry pump 88 is but one example of the numerous mechanisms that may be used to meter the flow of the abrasive slurry 82 into the fluid jet heads 14. Each of the fluid jet heads 14 also receives a high pressure fluid from high pressure pump 50 through the high pressure line 54. Once the high pressure fluid enters the fluid jet head 14, it flows through the orifice to form a high velocity fluid stream in the mixing chamber. As the abrasive slurry 82 enters the fluid jet head 14, it is pulled into and mixed with the high velocity fluid stream in the mixing chamber. The mixture exits the fluid jet head 14 through the nozzle 15 as an abrasive jet stream directed toward the support assembly 70. An open top catch tank 90 catches the abrasive jet stream after it penetrates the sheet 75 supported on the support assembly 70. The catch tank 90 surrounds the support assembly 70, which rests on a bottom surface of the catch tank 90.

The abrasive slurry 82 is formed by mixing water, abrasive particles, a surfactant or surfactants, and an acid or a base. As discussed above, the abrasive slurry 82 is mixed in the fluid jet heads 14 with the high pressure fluid from high pressure pump 50 to form the fluid jet stream. The resulting abrasive fluid jet stream can provide a chemical/mechanical cut and polish (CMCP) action that permits improvement in cycle times, costs and/or disk substrate quality. For example, three steps in the prior art techniques for making disk substrates, i.e., coring, breaking and edge polishing, can be accomplished simultaneously in one step by the present invention. In effect, the present invention can reduce three steps into one. Moreover, unlike in prior art techniques for making disk substrates, structural integrity issues do not arise because the edges of the disk substrates produced according to the present invention are damaged to a lesser extent.

The concentration of the water in the abrasive slurry 82 may range generally from 50–100 wt-%, preferably from about 60–85 wt-%, and most preferably about 65–75 wt-%.

A number of products are commercially available for use as the abrasive particles in the abrasive slurry 82, including garnet, zircon, sand or the like. Any such commercially available products, or combination thereof, may be used as the abrasive particles in the abrasive slurry 82. As discussed in more detail below, the abrasive particles may include recycled scrap from unused portions of the sheet 75 and/or recycled abrasive particles from the catch tank 90. The concentration of the abrasive particles in the abrasive slurry 82 may range generally from 0–50 wt-%, preferably from about 15–40 wt-%, and most preferably about 25–35 wt-%. Preferably, the abrasive particles have a nominal particle size no coarser than about 220 grit and no finer than about 1500 grit (i.e., having a nominal diameter of about 8–64 microns), and more preferably no coarser than about 300 and no finer than about 1500 grit (i.e., having a nominal diameter of about 8–49 microns). The preferred abrasive particle size, however, depends on the particular materials involved (e.g., the composition of the sheet 75 and the composition of the abrasive slurry 82, including the abrasive particle type), as well as the desired edge surface finish and cutting rate (i.e., the rate at which the fluid jet head is moved over the sheet as the abrasive fluid jet stream cuts the sheet). Typically, the smaller the abrasive particles, the better the edge surface finish; while the larger the abrasive particles, the better (faster) the cutting rate. In any event, the abrasive particles are relatively fine and are preferably delivered to the fluid jet head in a slurry because they tend to be self cohesive (flocculate and/or agglomerate) and plug the abrasive line.

As mentioned above, smaller abrasive particles typically provide improved edge surface finish as compared to larger abrasive particles. For example, an annular disk substrate cut from a glass sheet using garnet particles having a 40 micron nominal particle size has a superior edge surface finish as compared to that of an annular disk substrate cut from the same glass sheet using garnet particles having a 125 micron nominal particle size. Moreover, the edge surface finish produced by using fine abrasive particles can be superior to that produced by prior art techniques for making disk substrates. As a result, the present invention offers the ability to reduce or eliminate the need for subsequent polishing steps.

As also mentioned above, the preferred particle size depends, at least in part, on the composition of the abrasive slurry 82. For example, an annular disk substrate cannot readily be cut from a glass sheet using an abrasive slurry with garnet particles having a 12 micron nominal particle size unless a surfactant is present in the abrasive slurry to act as a surface tension reducing agent. Without the presence of the surfactant for surface tension reduction, such an abrasive slurry shatters the glass sheet rather than cutting it. The presence of a surfactant in the abrasive slurry 82 for at least the purpose of surface tension reduction (and, optionally, for the additional purpose of flocculation or dispersion) is desirable for abrasive particles of all sizes. For purposes of the present invention, a surfactant (or surface active agent) is a substance when present at low concentration in a system has the property of adsorbing onto the surfaces and/or interfaces of the system and of altering to a marked degree the surfaces and/or interfacial free energy of those surfaces.

A number of surfactants that function as surface tension reducing agents are commercially available, any of which may be used as the surfactant for surface tension reduction in the abrasive slurry 82. Exemplary surfactants for surface tension reduction include Neodol 1–9 (available from Shell Oil Company), Brij 30 (available from ICI Americas Inc. Corporation), CorAdd 9192LF (available from Coral Chemical Company, Paramount, Calif.), CorAdd 9195 (available from Coral Chemical Company, Paramount, Calif.), CorAdd (available from Coral Chemical Company, Paramount, Calif.), propylene glycol and ethylene glycol. Preferably, the surfactant for surface tension reduction is a mixture of Brij 30 and propylene glycol. The concentration of the surfactant for surface tension reduction in the abrasive slurry 82 may range generally from 0–10 wt-%, preferably from about 0.01–5 wt-%, and most preferably about 0.03–0.33 wt-%.

Exemplary inorganic acids that may be used in the abrasive slurry 82 include nitric acid, nitrous acid, sulfuric acid, sulfurous acid, sulfamic acid, phosphoric acid, pyrophosphoric acid, phosphorous acid, perchloric acid, hydrochloric acid, chlorous acid, hypochlorous acid, hydrofluoric acid, carbonic acid, chromic acid, and combinations thereof. Alternatively, or in addition to such inorganic acids, organic acids may be used. Exemplary organic acids that may be used in the abrasive slurry 82 include polyacrylic acid, citric acid, lactic acid, etc., and combinations thereof Preferably, the acid is phosphoric acid and/or polyacrylic acid. The concentration of the acid in the abrasive slurry 82 may range generally from zero to the maximum concentration (saturation), preferably from about 0.001–1.0 Formal, and most preferably about 0.01–0.1 Formal. Of course, the choice of the acid and its concentration in the abrasive slurry 82 depends, at least in part, on the composition of the sheet 75.

Due to the acidic (or, as discussed below, basic) nature of the abrasive slurry 82, it is desirable for sake of safety to enclose at least a portion of the fluid jet cutting system 10 in a protective shroud to prevent the fluid jet stream from inadvertently spraying about.

The abrasive slurry 82 may also contain small polishing particles that are smaller than the abrasive particles to affect polishing. The small polishing particles are relatively small particles of a material (preferably, inorganic and fairly hard) that has a surface polishing effect on the sheet 75. Exemplary small polishing particles include lanthanide oxide particles, diamond particles, SiC particles, alumina particles, boron carbide particles, and combinations thereof. With the addition of small polishing particles to the abrasive slurry 82, the abrasive fluid jet stream "polishes as it cuts." This polishing action reduces cycle times and costs by minimizing or eliminating a separate edge polishing process. Lanthanide oxide is understood to include an oxide of one or more of the rare earth elements of the lanthanide series according to the Periodic Table of Elements, which includes elements 57–71. The abrasive slurry 82 may contain cerium oxide particles, for example, having a nominal particle size of 3 microns, for example. The concentration of the small polishing particles in the abrasive slurry 82 may range generally from 0–37 wt-%, preferably from about 11–29 wt-%, and most preferably about 18–26 wt-%. If small polishing particles are used in the abrasive slurry 82, the concentration of the abrasive particles is preferably reduced. In this case, the concentration of the abrasive particles in the abrasive slurry 82 may range generally from 0–14 wt-%, preferably from about 4–11 wt-%, and most preferably about 6–10 wt-%.

The surfactant may serve other purposes beyond surface tension reduction. For example, the surfactant (and/or an additional surfactant and/or other material, e.g., a salt) may cause the abrasive particles to group together or "flocculate".

When flocculation occurs, the abrasive particles are loosely held together, i.e., the particles either touch each other or are bridged by the surfactant, and hence are dispersed by stirring. Flocculation is distinct from "agglomeration", wherein the abrasive particles have enough surface to surface contact that standard stirring will not disperse them. Flocculation is also distinct from "aggregation", wherein the abrasive particles are actually combined with each other, and hence are not dispersed by stirring. Flocculation of the abrasive particles is advantageous because smaller abrasive particles may be used in the slurry to improve edge finish, but without the typical degradation of the cutting rate. Small abrasive particles typically require a slower cut rate, but flocculation makes these particles behave as larger particles with respect to cut rate. Exemplary surfactants that may be used in the abrasive slurry 82 to cause flocculation include high molecular weight (e.g., MW=50,000 or 90,000 or 250,000) polyacrylic acid and CorAdd 9192LF (available from Coral Chemical Company, Paramount, Calif.). There are numerous other commercially available surfactants, many of which are believed to be effective in flocculating the abrasive particles in the abrasive slurry 82. The concentration of the surfactant in the abrasive slurry 82 for the purpose of flocculation may range generally from 0–1 wt-%, preferably from about 0.01–0.5 wt-%, and most preferably about 0.03–0.3 wt-%.

Flocculation may be induced by other mechanisms such as by pH adjustment and the addition of a salt, wherein the Coulombic repulsion forces between the abrasive particles are reduced allowing the particles to flocculate.

The surfactant may serve another purpose beyond surface tension reduction. As an alternative to flocculation, the surfactant (and/or an additional surfactant) may cause dispersion of the abrasive particles in the abrasive slurry 82. The abrasive particles may be dispersed (i.e., separated from each other) by an organic and/or inorganic surfactant and pH adjustment that puts a charge on the surface. Exemplary surfactants that may be used in the abrasive slurry 82 to cause dispersion include low molecular weight (e.g., MW=2,000) polyacrylic acid and CorAdd 9195 (available from Coral Chemical Company, Paramount, Calif.). There are numerous other commercially available surfactants, many of which are believed to be effective in dispersing the abrasive particles in the abrasive slurry 82. The concentration of the surfactant in the abrasive slurry 82 for the purpose of dispersion may range generally from 0–1 wt-%, preferably from about 0.01–0.5 wt-%, and most preferably about 0.03–0.3 wt-%.

The abrasive slurry 82 may also contain other additives that produce a desired chemical and/or mechanical effect. For example, the abrasive slurry 82 may contain an additive known for complexing/etching/dissolving glass, such as ethylene oxide polymers, amines, alkaloids and/or a caustic etchant (in lieu of the acid) to provide a shift in pH to the basic side. Useful caustic etchants generally include inorganic bases such as lithium hydroxide, sodium hydroxide, potassium hydroxide, calcium hydroxide, and ammonium hydroxide; and/or organic bases such as amine compounds. The concentration of the base in the abrasive slurry 82 may range generally from zero to maximum concentration (saturation), preferably from about 0.001–2 Formal, and most preferably about 0.1–1.0 Formal. Of course, the choice of the base and its concentration in the abrasive slurry depends, at least in part, on the composition of the sheet 75.

The abrasive slurry 82 may contain an additive and/or may be stirred to keep the abrasive particles in suspension so that the abrasive slurry 82 remains uniform. Stirring may be provided by, for example, a rotating blade stirrer 87.

A scrap portion of the sheet 75 may be ground to produce glass particles for subsequent use as the abrasive particles in the abrasive slurry 82. Alternatively, or in addition, recycled abrasive particles from the catch tank 90 may be reused as the abrasive particles in the abrasive slurry 82. Each of these recycling steps improves costs by reducing raw material costs and waste disposal costs. For example, the abrasive slurry 82 may include glass or ceramic particles formed by grinding scrap portions of a glass or ceramic sheet 75 using a conventional grinding process, such as a ball mill process. Preferably, these scrap based abrasive particles have a nominal particle size no coarser than about 220 grit and no finer than about 1500 grit (i.e., having a nominal diameter of about 8–64 microns), and more preferably no coarser than about 300 and no finer than about 1500 grit (i.e., having a nominal diameter of about 8–49 microns). The concentration of the scrap based abrasive particles in the abrasive slurry 82 may range generally from 0–50 wt-%, preferably from about 15–40 wt-%, and most preferably about 25–35 wt-%.

Figure 2:
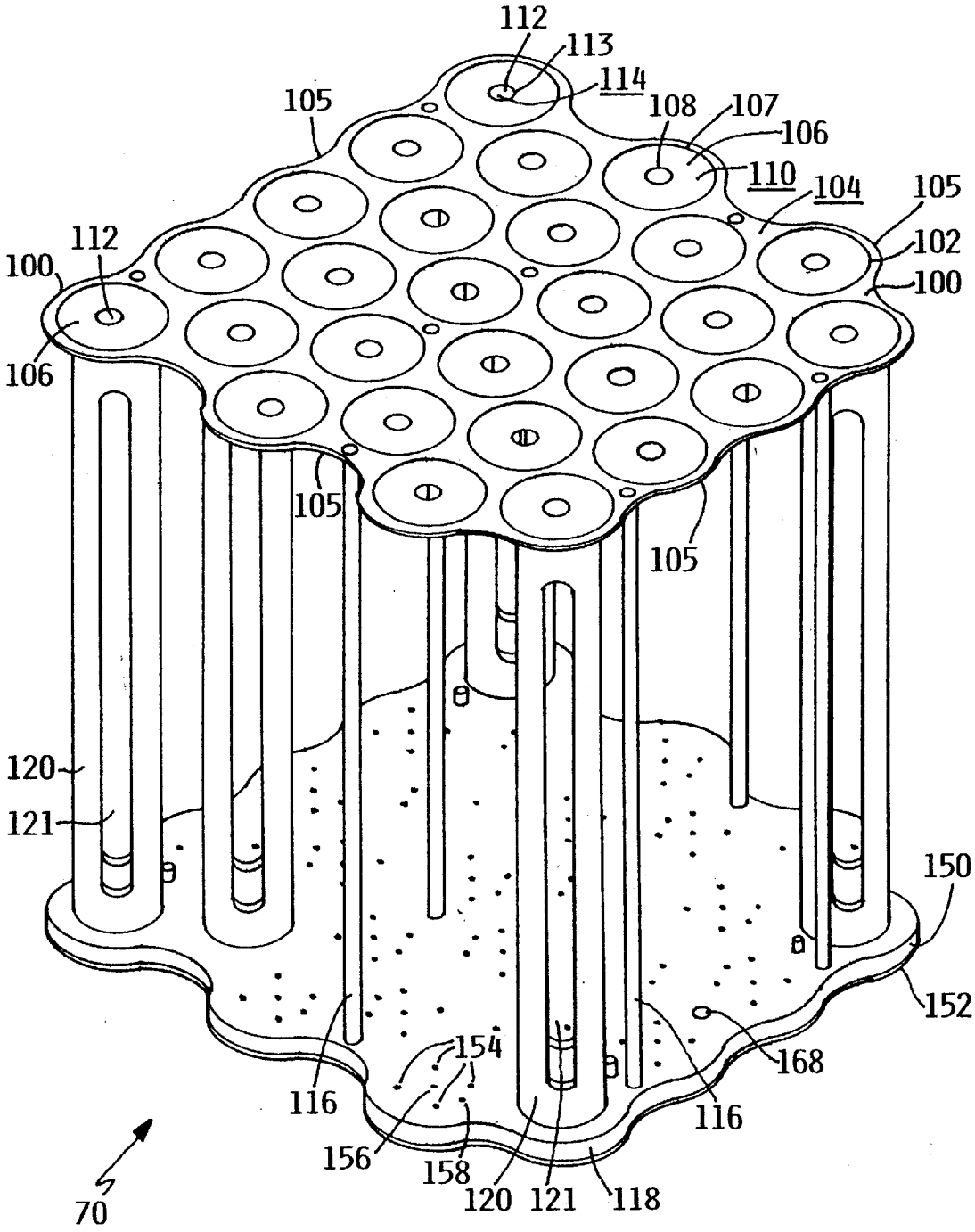
FIG. 2 is an enlarged perspective view of a support assembly of the fluid jet cutting apparatus shown in FIG. 1, with portions removed for the sake of clarity.
Figure 3:
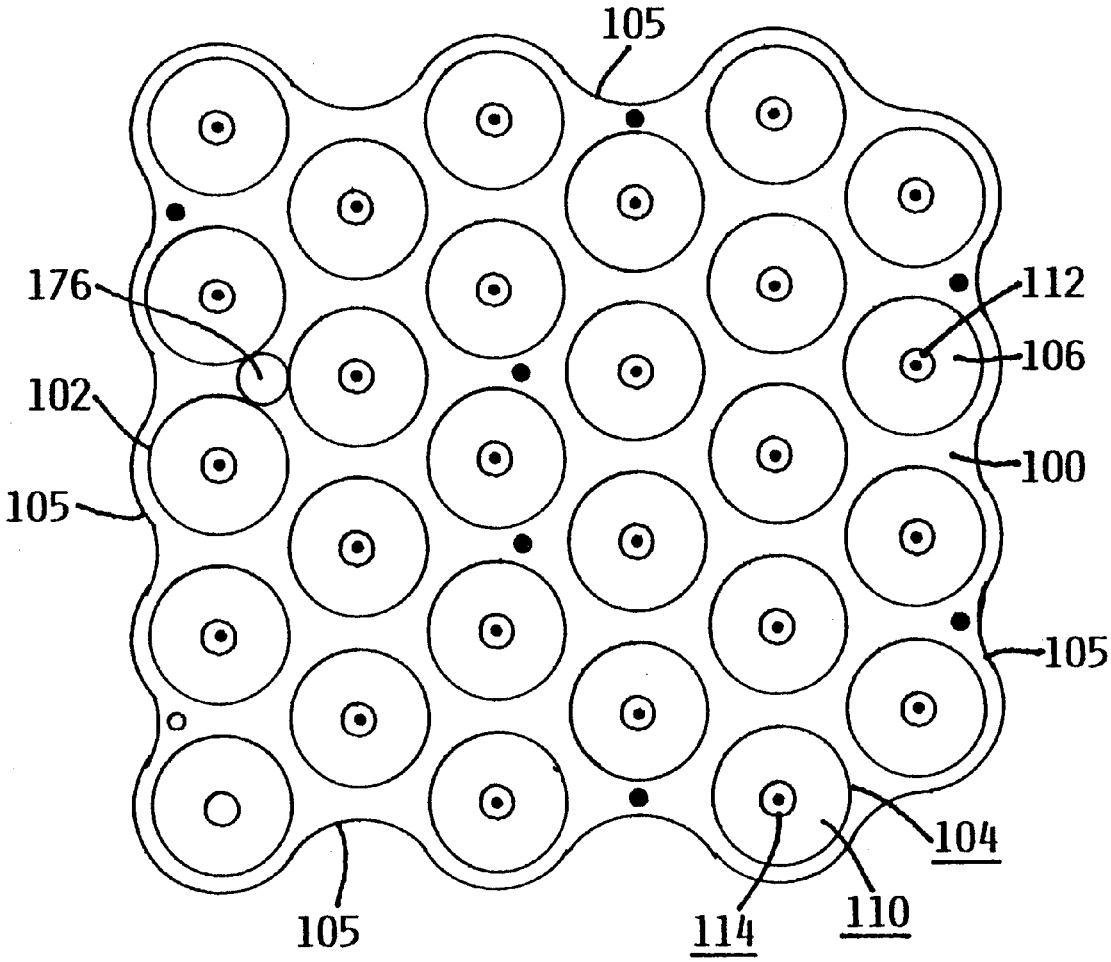
FIG. 3 is an enlarged top plan view of a support assembly of the fluid jet cutting apparatus shown in FIG. 1.
Figure 4:
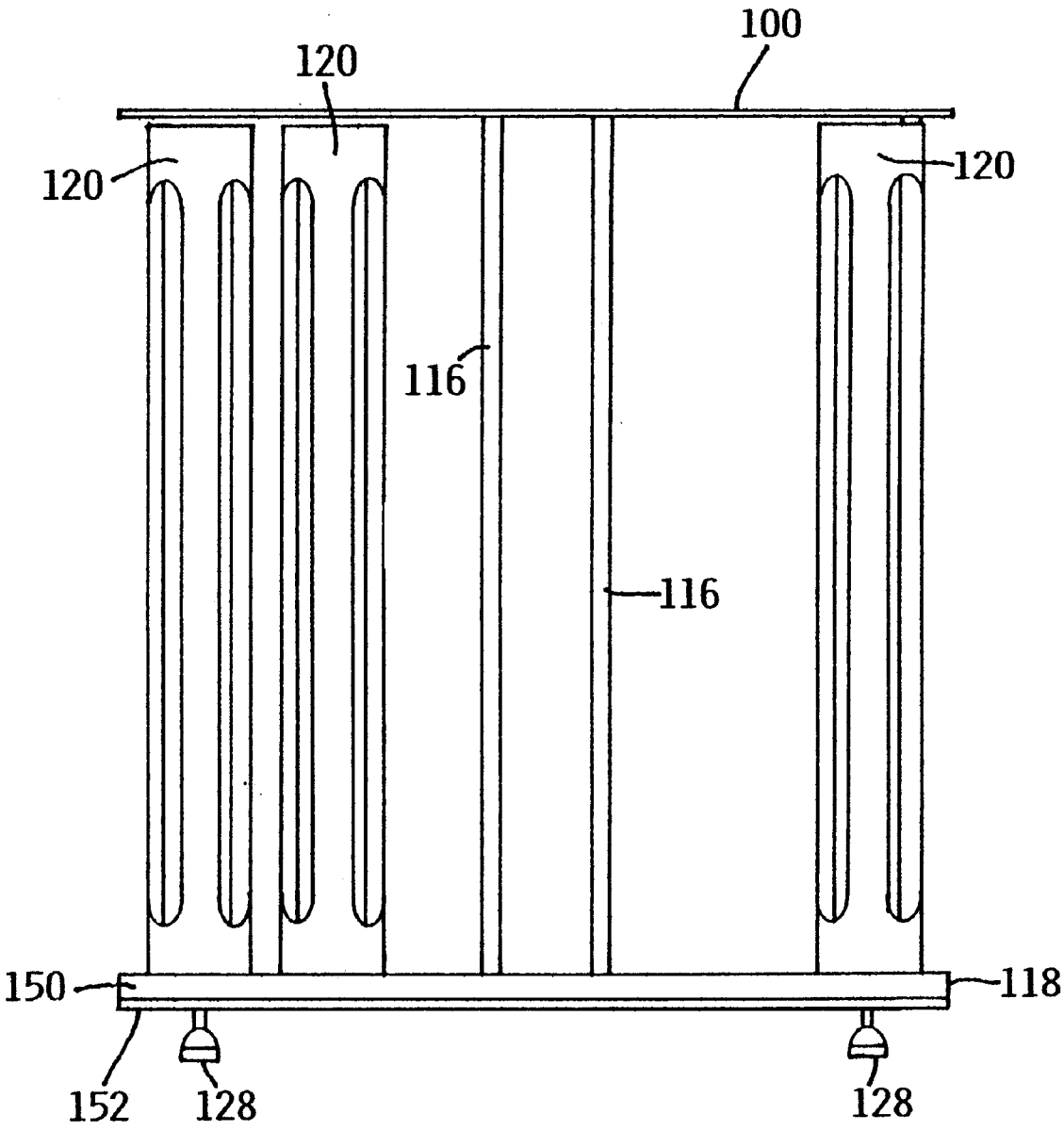
FIG. 4 is an enlarged side elevation view of a support assembly of the fluid jet cutting apparatus shown in FIG. 1, with portions removed for the sake of clarity.

Referring now to FIGS. 2–4, the support assembly 70 includes a peripheral support member 100 having twenty-seven central openings 102 therein. The central openings 102 of the peripheral support member 100 are substantially circular like the outside edge of the disk substrate to be cut from the sheet. However, the central openings 102 of the peripheral support member 100 are slightly larger than the outside edge of the disk substrate. This sizing reduces the likelihood of the central opening 102 of the peripheral support member 100 being damaged by the fluid jet stream used to cut the outside edge of the disk substrate. The peripheral support member 100 includes a generally planar support surface 104 for supporting a peripheral portion of the sheet, i.e., a portion that is to be scrap lying outside the outside edge of the disk substrate.

The support assembly 70 also includes twenty-seven annular support members 106 each having a central opening 108 therein. The annular support members 106 each have a generally circular peripheral edge 107 having a diameter slightly smaller than the outside edge of the disk substrate to be cut from the sheet. This sizing reduces the likelihood of the circular peripheral edge 107 of the annular support member 106 being damaged by the fluid jet stream used to cut the outside edge of the disk substrate. The central openings 108 of the annular support members 106 are substantially circular like the inside edge of the disk substrate. However, the central openings 108 of the annular support members 106 are slightly larger than the inside edge of the disk substrate. This sizing reduces the likelihood of the central opening 108 of the annular support member 106 being damaged by the fluid jet stream used to cut the inside edge of the disk substrate. Each annular support member 106 includes a generally planar support surface 110 for supporting an annular portion of the sheet, i.e., a portion which will form the annular disk substrate. The support surfaces 110 of the annular support members 106 are positioned inside the central openings 102 of the peripheral support member 100 and are substantially coplanar with the support surface 104 of the peripheral support member 100. Preferably, as discussed in more detail below, each annular support member 106 includes a vacuum port (not shown in FIGS. 2–4) for pulling the annular portion of the sheet against the support surface 110 of the annular support member 106.

The support assembly 70 also includes twenty-seven hole support members 112 each having a generally circular peripheral edge 113 having a diameter slightly smaller than the inside edge of the disk substrate to be cut from the sheet.

This sizing reduces the likelihood of the peripheral edge 113 of the hole support member 112 being damaged by the fluid jet stream used to cut the inside edge of the disk substrate. Each hole support member 112 includes a generally planar support surface 114 for supporting a hole portion of the sheet, i.e., a portion that is to be scrap lying inside the inside edge of the disk substrate. The support surfaces 114 of the hole support members 112 are positioned inside the central openings 108 of the annular support members 106 and are substantially coplanar with the support surfaces 110 of the annular support members 106 and the support surface 104 of the peripheral support member 100. At each of the locations at which a disk is to be cut from the sheet, the central opening 102 of the peripheral support member 100, the peripheral edge 107 of the annular support member 106, the central opening 108 of the annular support member 106, and the peripheral edge of the hole support member 112 are generally concentric.

Of course, the support assembly may support a sheet from which any number of annular disk substrates are to be cut. Accordingly, the invention is not limited to the twenty-seven annular disk substrate arrangement shown. Moreover, the support assembly may support a sheet from which any object is to be cut. Accordingly, the invention is not limited to cutting annular disk substrates as shown.

Preferably, the support members of the support assembly are arranged in nested rows to increase the number of objects that may be cut from a given size sheet. For example, as best seen in FIGS. 2 and 3, the central openings 102 of the peripheral support member 100 are preferably arranged in nine nested rows, each row having three central openings 102. With this arrangement, twenty-seven (27) annular disk substrates having a diameter of 95 mm can be cut from a single-layer glass sheet that is about 610 mm×610 mm. Without nesting, this same single-layer glass sheet would yield no more than twenty-five (25) 95 mm annular disk substrates (i.e., five rows, each having five annular disk substrates). In another example, nesting increases the yield from a single-layer glass sheet that is about 1160 mm×845 mm to eighty (80) 95 mm annular disk substrates (without nesting, this same single-layer glass sheet would yield no more than seventy (70) 95 mm annular disk substrates). In yet another example, nesting increases the yield from a single-layer glass sheet that is about 1250 mm×895 mm to one hundred ten (110) 95 mm annular disk substrates (without nesting, this same single-layer glass sheet would yield no more than eighty-eight (88) 95 mm annular disk substrates).

Preferably, as best seen in FIGS. 2 and 3, the peripheral support member 100 has edges 105 that are scalloped in accordance with the arrangement of adjacent central openings 102 for matingly receiving, in jigsaw puzzle-like fashion, an inversely scalloped edge 105' (shown in FIG. 1) of an additional peripheral support member 100' (the outline of which is shown in phantom lines in FIG. 1) of an additional support assembly 70'. The additional support assembly 70' is preferably identical to support assembly 70. The scalloped edge 105 permits the nesting pattern of the central openings 102 in the peripheral support member 100 to continue into the additional peripheral support member 100' for a larger glass sheet. Thus these modular support assemblies are scalable, i.e., one, two or more of these modular support assemblies may be used to accommodate sheets having different sizes, without disruption of the yield boosting nesting pattern. Also, each of these modular support assemblies is lighter in weight, and thus easier to remove for maintenance or replacement, than a single, larger support assembly.

The peripheral support member 100 is attached to a top end of eight standoffs 116 using a suitable attachment mechanism, such as a screw (now shown) or the like. The bottom end of each standoff 116 is attached to a baseplate assembly 118 using a suitable attachment mechanism, such as a screw (not shown) or the like. Of course, a different number of standoffs 116 may be used.

Each annular support member 106 is attached to a top end of a main column 120 using a suitable attachment mechanism, such as a series of four screws (now shown) or the like. Each main column 120 includes four elongated slots 121 through which fluid from the fluid jet stream may move with relative ease. Of course, a different number of elongated slots 121 may be used. The bottom of end of each main column 120 is attached to the baseplate assembly 118 using a suitable attachment mechanism, such as a series of four screws (now shown) or the like.

Each hole support member 112 is attached to a top end of a center column 122 (shown in FIG. 10) using a suitable attachment mechanism, such as a screw (not shown) or the like. The bottom end of each center column 122 is attached to the baseplate assembly 118 using a suitable attachment mechanism, such as a screw (now shown) or the like.

Figure 8:
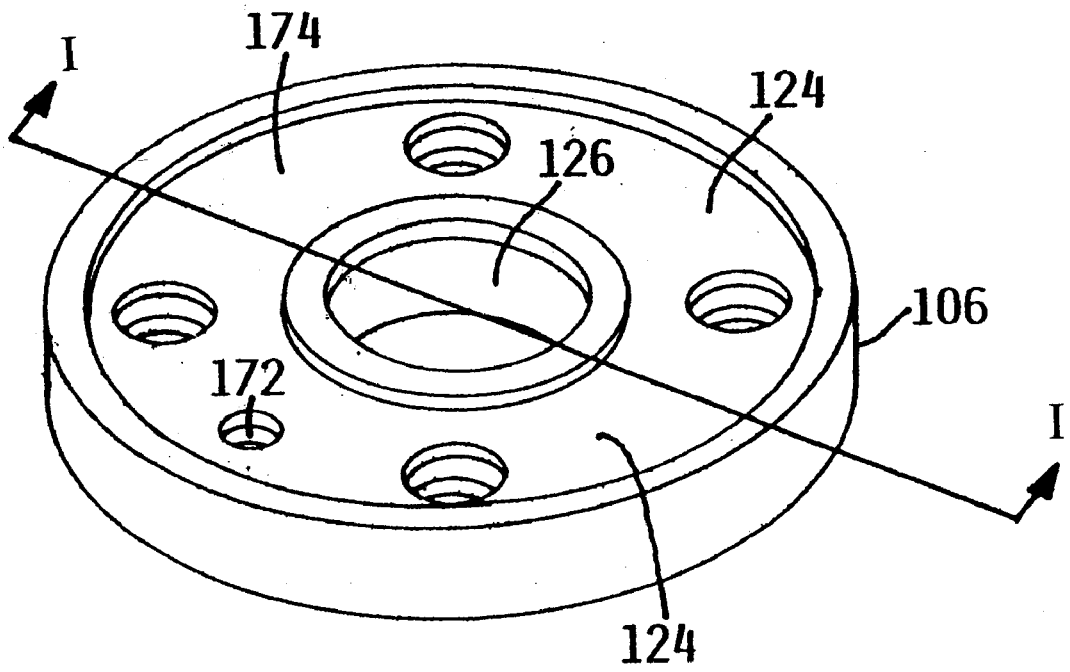
FIG. 8 is an enlarged perspective view of an annular support member of the support assembly shown in FIG. 2.
Figure 9:
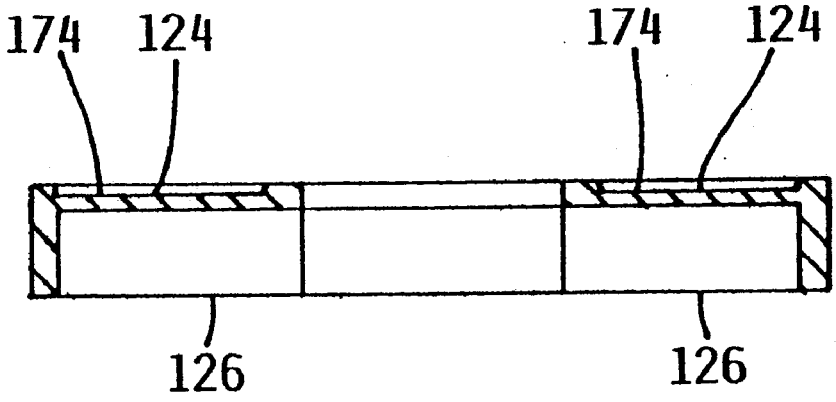
FIG. 9 is a cross sectional view taken along line I—I of FIG. 8.

Preferably, the peripheral support member 100, annular support member 106, hole support member 112, standoff 116, baseplate assembly 118, main column 120, and center column 122 are made of relatively wear resistant materials to minimize wear by the fluid jet stream. For example, the peripheral support member 100, annular support member 106, hole support member 112, standoff 116, baseplate assembly 118, main column 120, and center column 122 may be made from aluminum. As discussed in more detail below, however, at least one of the support members, i.e., peripheral support member 100, annular support member 106 and hole support member 112, preferably includes a resilient cover member to improve the vacuum seal between the support member and the sheet and/or protect the sheet from damage due to contact with the support member. For example, as best seen in FIGS. 8 and 9, the annular support member 106 may include a resilient cover member 124 made of rubber, for example, secured over a base member 126 made of aluminum, for example.

Referring back to FIG. 4, the baseplate assembly 118 preferably includes three or more levellers 128 (two are shown) to adjust the plane of the baseplate assembly 118 and hence the plane of the support surfaces of the support members, i.e., the peripheral support member 100, annular support member 106, hole support member 112. For example, each of the levellers 128 may include a threaded shaft (not shown) that is received in a treaded hole (not shown) in the baseplate assembly 118. Consequently, one or more of the levellers 128 may be turned to adjust the plane of the baseplate assembly 118 and hence the plane of the support surfaces of the support members, i.e., the peripheral support member 100, annular support member 106, hole support member 112. The plane of these support surfaces is typically adjusted to be perpendicular to the fluid jet stream.

Figure 5:
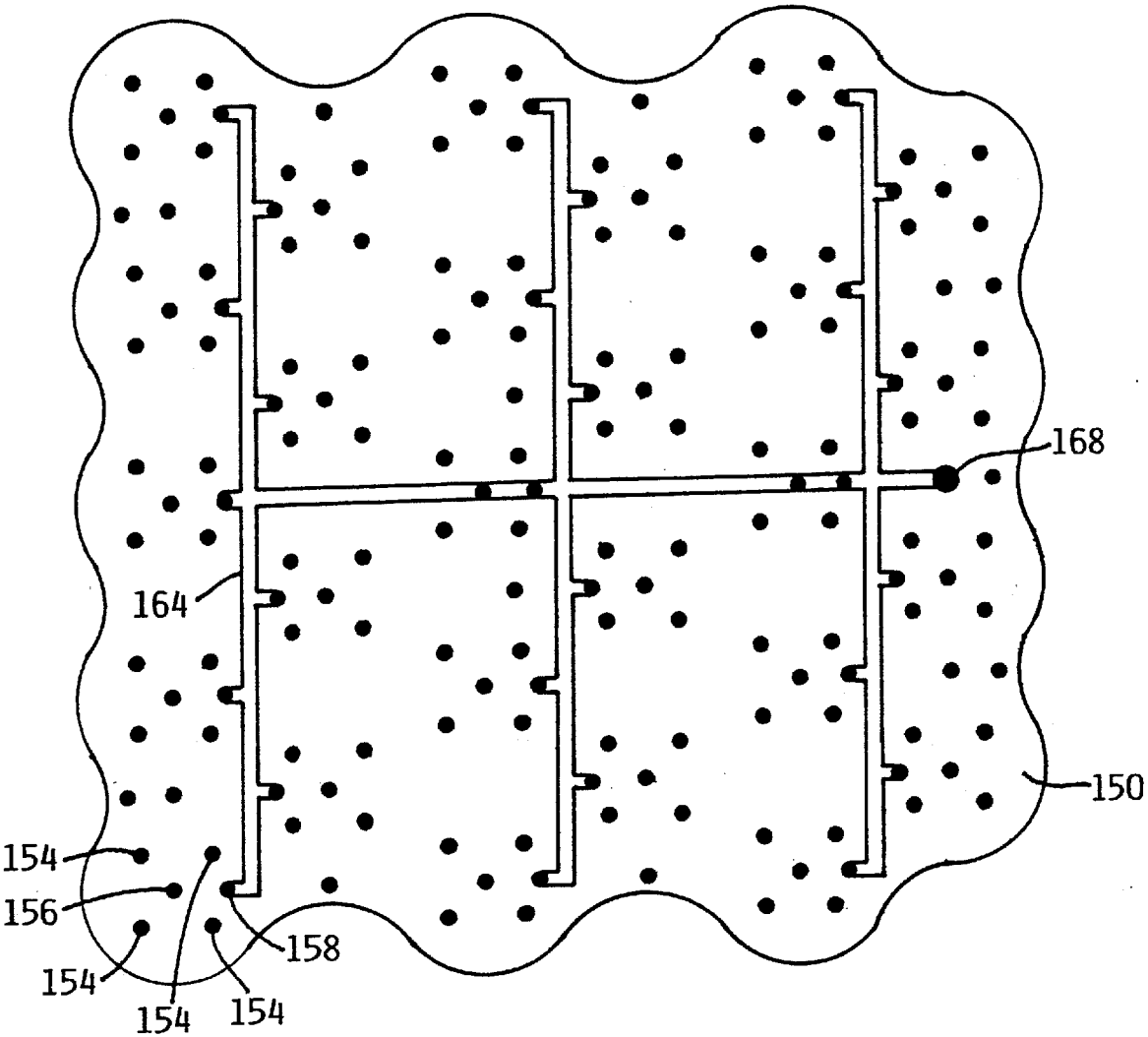
FIG. 5 is an enlarged top plan view of a baseplate of the support assembly shown in FIG. 2.
Figure 7:
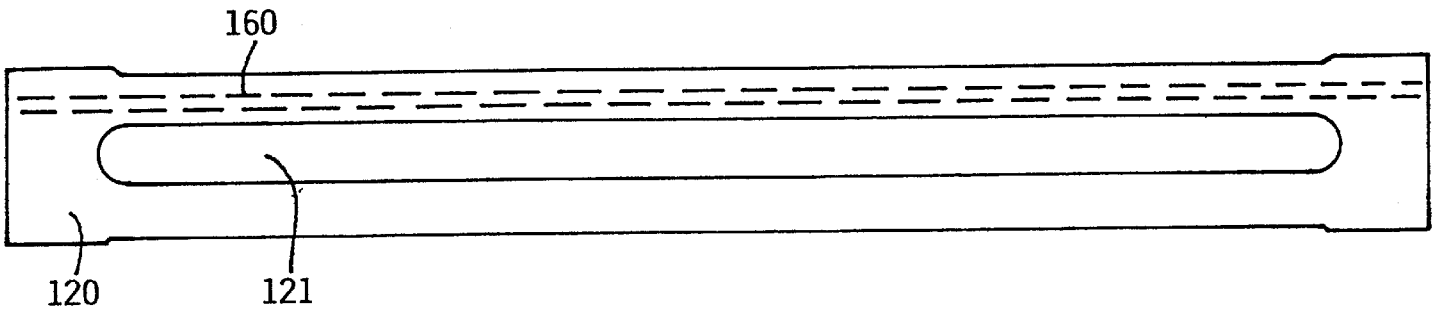
FIG. 7 is an enlarged side elevation view of a main column of the support assembly shown in FIG. 2.
Figure 6:
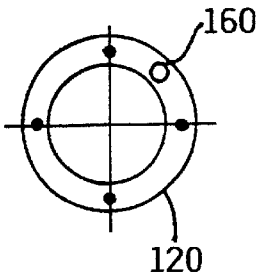
FIG. 6 is an enlarged top plan view of a main column of the support assembly shown in FIG. 2.

Referring back to FIG. 2, the baseplate assembly 118 includes a baseplate 150 and a cover plate 152. The baseplate 150 and cover plate 152 include, a hole to attach each standoff 116, a series of four holes 154 to attach each main column 120 and one hole 156 to attach each center column 122. In addition, the baseplate 150 includes a vacuum hole 158 for each of the main columns 120. Each vacuum hole 158 is in fluid communication with a vacuum passage 160 (shown in FIGS. 6 and 7) through each of the main columns 120. As shown in FIG. 5, the underside of baseplate 150 (i.e., the side that contacts the cover plate 152) includes a vacuum distribution trough 164 in fluid communication with each of the vacuum holes 158 and a vacuum source hole 168. The vacuum source hole 168 is connected to a vacuum source (not shown) through a vacuum line (not shown), for example. To prevents leakage of fluid into along the vacuum distribution trough 164, the baseplate 150 is sealed against cover plate 152. For example, the baseplate 150 and cover plate 152 may be sealed against each other by the screws attaching the standoffs 116, main columns 120 and center columns 122 to the baseplate assembly 118. Of course, other means of distributing the vacuum to the annular support members 106 and/or to the other support members are possible. For example, a vacuum line may be connected directly to each of the annular support members 106 and/or to the other support members. Therefore, the invention is not limited to the vacuum distribution means illustrated, i.e., the vacuum source hole 162, vacuum distribution trough 164, vacuum hole 158, and vacuum passage 160.

Figure 10:
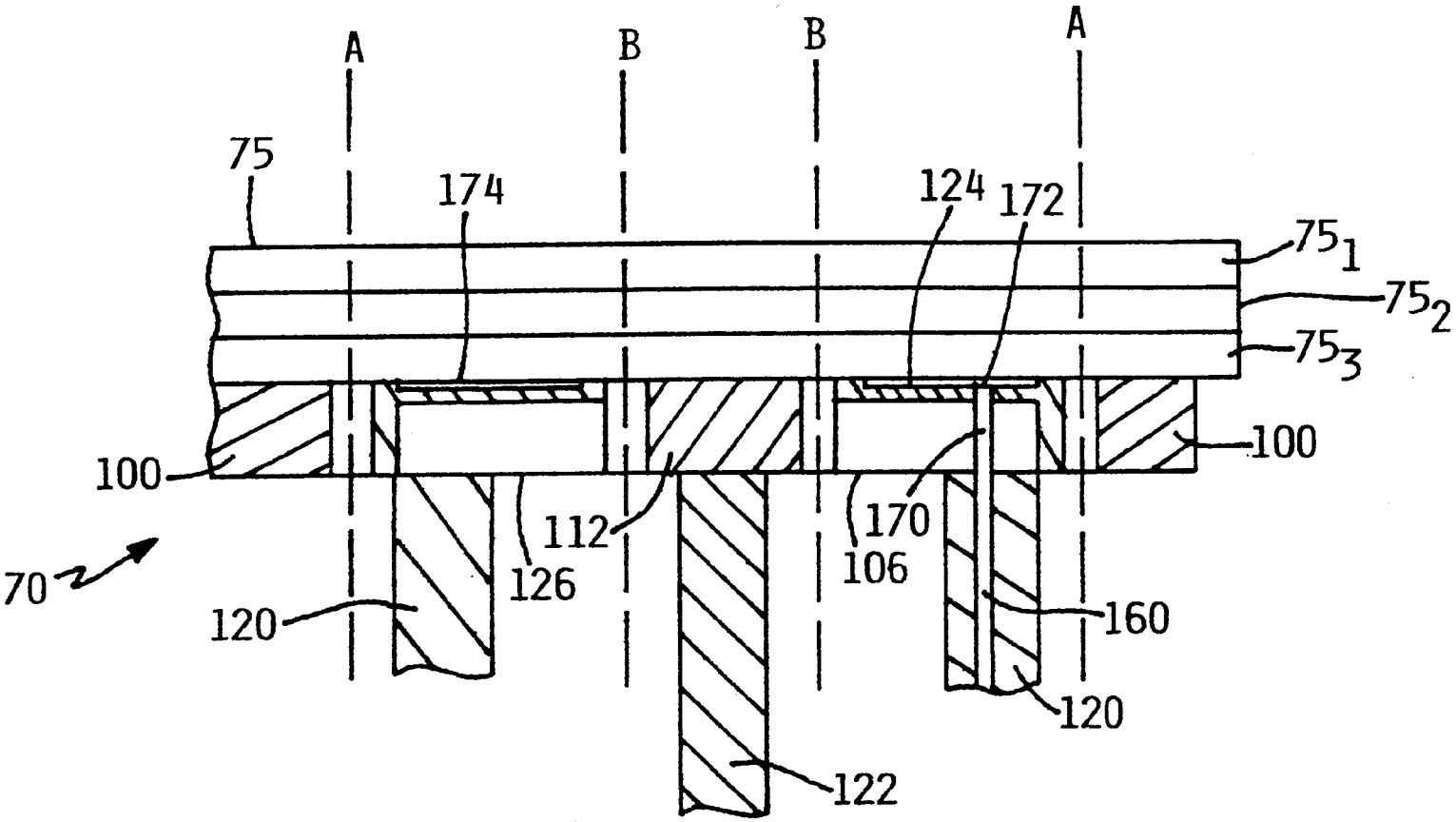
FIG. 10 is a cross sectional view of a portion of the support assembly shown in FIG. 2 supporting a portion of a sheet that is to be cut by a single fluid jet stream to simultaneously form three annular disk substrates.

Attention is now directed to FIG. 10, which is a cross sectional view of a portion of support assembly 70 supporting a portion of sheet 75 that is to be cut by a single fluid jet stream to simultaneously form three annular disk substrates. The vacuum passage 160 through each main column 120 is in fluid communication with a vacuum hole 170 in base member 126 of the annular support member 106, a vacuum port 172 in resilient cover member 124 of the annular support member 106, and finally an annular vacuum depression 176 (best seen in FIGS. 8 and 9) in resilient cover member 124 of the annular support member 106. The sheet 75 is securely held against the resilient cover member 124 of the annular support member 106 by action of the vacuum, and thus movement of the sheet 75 during the cutting operation is reduced. The resilient cover member 124 of the annular support member 106 improves the vacuum seal between the annular support member 106 and the sheet 75, and also protects the sheet 75 from damage due to contact with the annular support member 106. The often considerable weight of the sheet 75 also acts to limit its movement during the cutting operation. Alternatively, vacuum ports may be included in the other support members in lieu of, or in addition to, the annular support member 106. Likewise, resilient cover members may be included on the other support members in lieu of, or in addition to, the annular support member 106.

A fluid jet stream from the fluid jet head is directed against the sheet 75 held on support assembly 70. The fluid jet head follows an outside edge path along the sheet 75 to form an outside edge of the disk substrate. Two points along the outside edge path are represented in FIG. 10 by dashed lines A. Similarly, the fluid jet head follows an inside edge path along the sheet 75 to form an inside edge of the disk substrate. Two points along the inside edge path are represented in FIG. 10 by dashed lines B. The peripheral support member 100 supports a peripheral portion of the sheet 75, i.e., a portion that is to be scrap lying outside the outside edge of the disk substrate. The peripheral portion of the sheet 75 lies outwardly of the outside edge path A. Each annular support member 106 supports an annular portion of the sheet 75, i.e., a portion which will form the annular disk substrate. The annular portion of the sheet 75 lies between the outside edge path A and the inside edge path B. Each hole support member 112 supports a hole portion of the sheet 75, i.e., a portion that is to be scrap lying inside the inside edge of the disk substrate. The hole portion of the sheet 75 lies inwardly of the inside edge path B.

To further improve production cycle times and costs, the sheet from which the objects are to be cut preferably includes a plurality of layers that are removably adhered to one another. Accordingly, a plurality of objects are simultaneously cut by a single fluid jet head. Once cut, the plurality of layers are separated to provide a plurality of objects. Thus, it is possible to simultaneously cut N×M objects using N multiple fluid jet heads to cut a sheet having M layers. For example, as shown in FIG. 10, sheet 75 includes three layers $75_1$, $75_2$ and $75_3$ that are adhered to one another when cut by the fluid jet head. Of course, any number of layers $75_M$ may be removably adhered to one another in lieu of the three shown in FIG. 10. The layers $75_1$, $75_2$ and $75_3$ may be removably adhered to one another by using the surface tension of a suitable fluid (e.g., water) inserted between layers $75_1$ and $75_2$ and between layers $75_2$ and $75_3$. For example, water may be sprayed in the form of a mist between layers $75_1$ and $75_2$ and between layers $75_2$ and $75_3$, which are then pressed together to form a single sheet 75. Alternatively, the layers $75_1$, $75_2$ and $75_3$ may be adhered to one another by a suitable adhesive (e.g., double sided adhesive tape) inserted between layers $75_1$ and $75_2$ and between layers $75_2$ and $75_3$. Preferably, if the layers $75_1$, $75_2$ and $75_3$ are adhered to one another using an adhesive, each surface of each of the layers $75_1$, $75_2$ and $75_3$ is covered with a protective layer (e.g., paper, plastic, or the like). Conveniently, such protective layers typically cover the surfaces of commercially available sheets to provide protection during shipping and handling. The protective layers are typically removably adhered to the surfaces of the sheet by electrostatic attraction or an adhesive. After being cut by the fluid jet head, the layers $75_1$, $75_2$ and $75_3$ are separated to provide three annular disk substrates. The layers $75_1$, $75_2$ and $75_3$ may be separated by any suitable chemical technique (e.g., immersion in a suitable solvent or suitable surface tension reducing agent) and/or mechanical technique (e.g., pulling, twisting and/or sliding one layer relative to another). Finally, any protective layers are then removed by peeling, for example.

A vacuum device may used be to load and center the sheet before the cutting operation and unload the various portions cut from the sheet after the cutting operation. The vacuum device may, for example, use a robotically controlled suction cup and/or series of coplanar suction cups to grip the top of the sheet. For example, the vacuum device may be used to load and center the sheet onto the support assembly before the cutting operation. After the cut has been made, a visual and/or optical system may identify the locations of the good (e.g., successfully cut) annular disk substrates and the bad (e.g., unsuccessfully cut) annular disk substrates. The vacuum device will then use the information obtained by the visual and/or optical system to unload the good annular disk substrates, and then unload the scrap material, i.e., the bad annular disk substrates as well as the hole and peripheral portions of the sheets. For example, the peripheral portion of the sheet may be contacted and unloaded after the cut has been made by suction cups at a location 176 (one such location shown in FIG. 3) between the annular portions.

Figure 11:
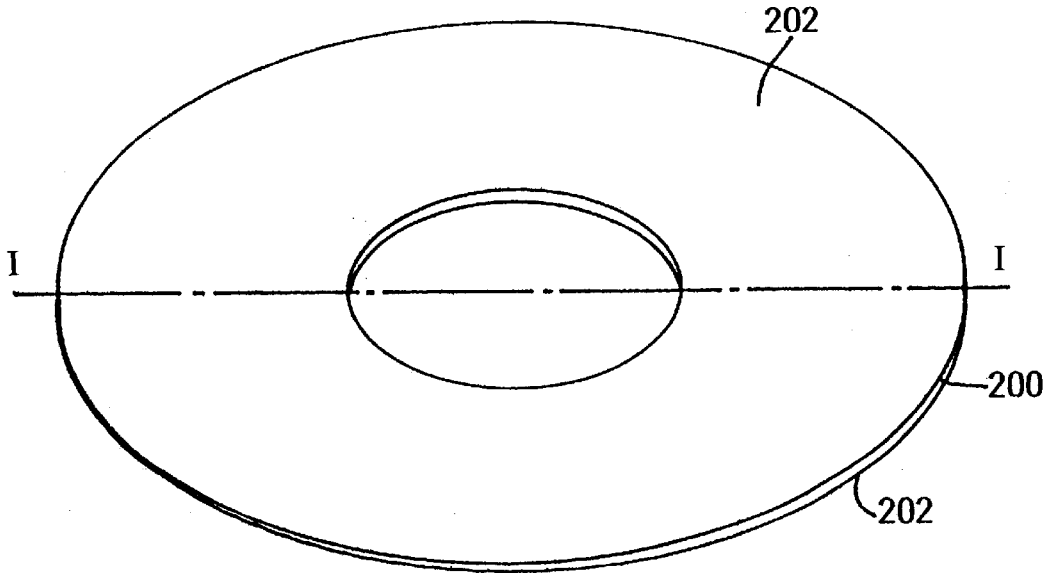
FIG. 11 is a perspective view of an annular disk substrate made according to an embodiment of the present invention, with the annular disk substrate covered with protective layers.
Figure 12:
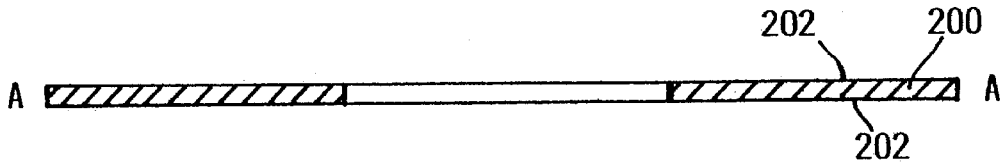
FIG. 12 is a cross sectional view taken along line I—I of FIG. 11.

FIGS. 11 and 12 show an example of an annular disk substrate 200 cut from a sheet, prior to removal of protective layers 202 that preferably cover at least one of the upper and lower surfaces of the annular disk substrate 202. Preferably, the protective layers 202 (e.g., paper, plastic, or the like) cover the sheet and hence the annular disk substrate 200 cut therefrom. The protective layers 202 permit improvement in the quality of the annular disk substrate 200. For example, the protective layers 202 may be used to protect the upper surface of the annular disk substrate 200 from being damaged by "overspray" caused by the fluid jet stream as it impinges on an area of the sheet adjacent to the cut and to protect the lower surface of the annular disk substrate 200 from being damaged by "chipout" caused by the ricochet of the fluid jet stream as it enters the catch tank. Conveniently, such protective layers typically cover the surfaces of commercially available sheets to provide protection during shipping and handling. The protective layers are typically removably adhered to the surfaces of the sheet by electrostatic attraction or an adhesive. After the annular disk substrate 200 has been cut from the sheet by the fluid jet head, the protective layers 202 may be removed by peeling, for example.

Alternatively, protection against overspray of the fluid jet stream may be accomplished by removably adhering a mask, e.g., an annular metal mask, on the surface of the sheet at each location where an annular disk substrate is to be cut. However, this alternative is less desirable because of alignment issues.

The Annular Disk Substrate

In the fabrication of the annular disk substrate 200 (shown in FIGS. 11 and 12), generally, compositions that may be used for the sheet include ceramics, glass-ceramics, glasses, polymers and metals, or composites thereof. Examples of materials that may be used include alumina, sapphire, silicon carbide, boron carbide, aluminosilicate glass, metal matrix composites, and aluminum/boron carbide composites. These compositions may be include any number of various overcoat layers, such as a glassy carbon layer.

Glass is generally a silicate material having a structure of silicon and oxygen where the silicon atom is tetrahedrally coordinated to surrounding oxygen atoms. Any number of materials may be used to form glass such as boron oxide, silicon oxide, germanium oxide, aluminum oxide, phosphorous oxide, vanadium oxide, arsenic oxide, antimony oxide, zirconium oxide, titanium oxide, aluminum oxide, thorium oxide, beryllium oxide, cadmium oxide, scandium oxide, lanthanum oxide, yttrium oxide, tin oxide, gallium oxide, indium oxide, lead oxide, magnesium oxide, lithium oxide, zinc oxide, barium oxide, calcium oxide, stronium oxide, sodium oxide, cadmium oxide, potassium oxide, rubidium oxide, mercury oxide, and cesium oxide.

Glass-ceramic may also be used. Glass-ceramics generally result from the melt formation of glass and ceramic materials by conventional glass manufacturing techniques. Subsequently, the materials are heat cycled to cause crystallization. Typical glass/ceramics are, for example, β-quartz solid solution, $SiO_2$; β-quartz; lithium metasilicate, $Li_2O$—$SiO_2$; lithium disilicate, $Li_2(SiO_2)_2$; β-spodumene solid solution; anatase, $TiO_2$; β-spodumene solid solution; rutile $TiO_2$; β-spodumene solid solution; mullite, $3Al_2O_3$—$2SiO_2$; β-spodumene dorierite, $2MgO$—$2Al_2O_3$—$5SiO_2$; spinel, $MgO$—$Al_2O_3$; MgO-stuffed; β-quartz; quartz; $SiO_2$; alpha-quatz solid solution, $SiO_2$; spinel, $MgO$—$Al_2O_3$; enstatite, $MgO$—$SiO_2$; fluorphlogopite solid solution, $KMg_3AlSi_3O_{10}F_2$; mullite, $3Al_2O_3$—$2SiO_2$; and (Ba, Sr, Pb)$Nb_2O_6$.

Ceramics are generally comprised of aluminum oxides such as alumina, silicon oxides, zirconium oxides such as zirconia or mixtures thereof. Typical ceramic compositions include aluminum silicate; bismuth calcium strontium copper oxide; cordierite; feldspar, ferrite; lead acetate trihydrate; lead lanthanum zirconate titanate; lead magnesium nobate (PMN); lead zinc nobate (PZN); lead zirconate titanate; manganese ferrite; mullite; nickel ferrite; strontium hexaferrite; thallium calcium barium copper oxide; triaxial porcelain; yttrium barium copper oxide; yttrium iron oxide; yttrium garnet; and zinc ferrite.

Aluminum-boron-carbide composite may also be used, preferably with a ratio of aluminum to boron carbide (vol. %) ranging from about 1:99 to 40:60. The specific stiffness of these materials typically ranges from about 11.1 to 21.2 Mpsi/gm/cc. This composite is commonly referred to as aluminum-boron-carbide composites or AIBC composites.

The Data Storage Device

Figure 13:
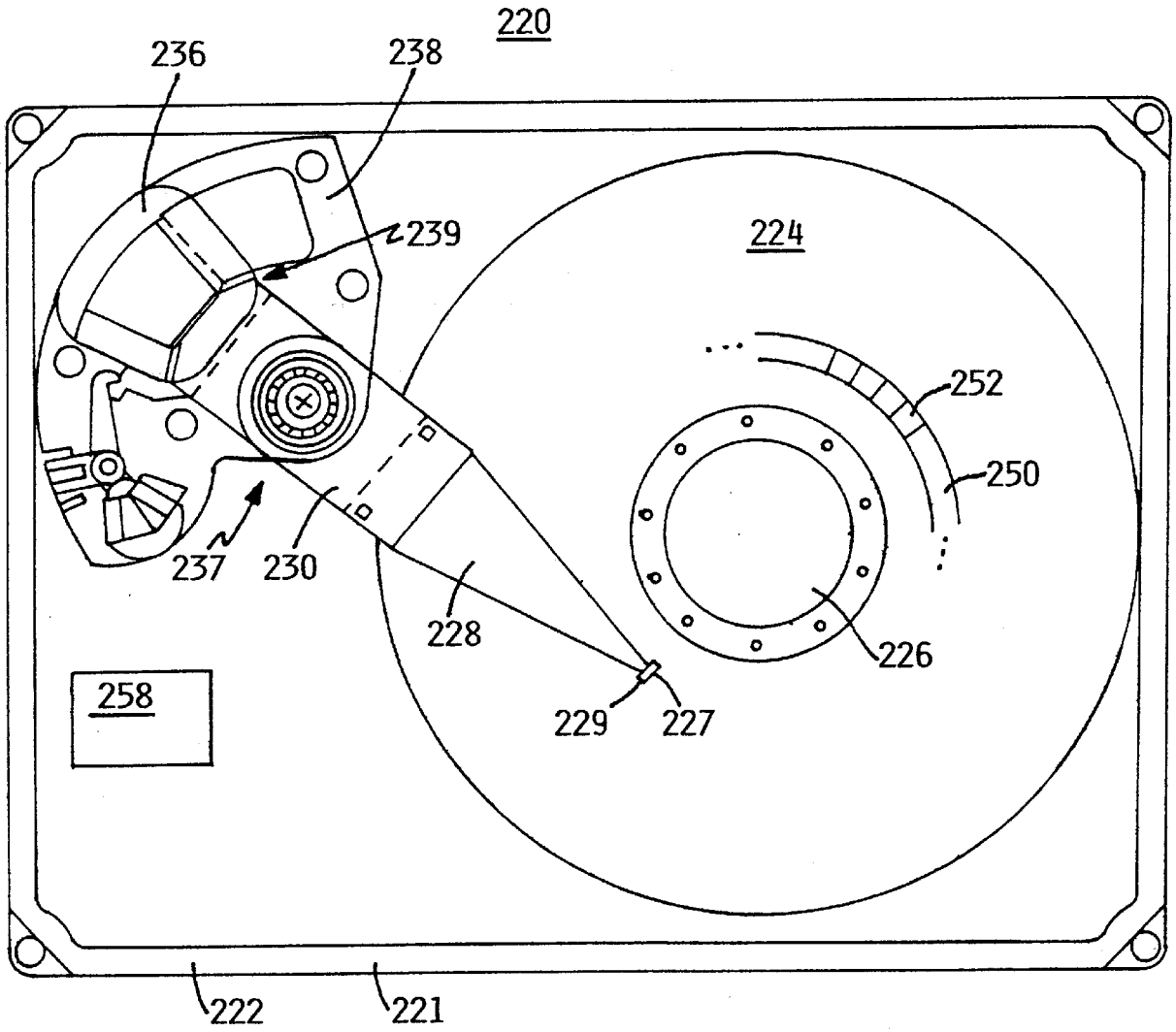
FIG. 13 is a top plan view of a data storage system with its upper housing cover removed and employing one or more data storage disks having an annular disk substrate made according to an embodiment of the present invention.
Figure 14:
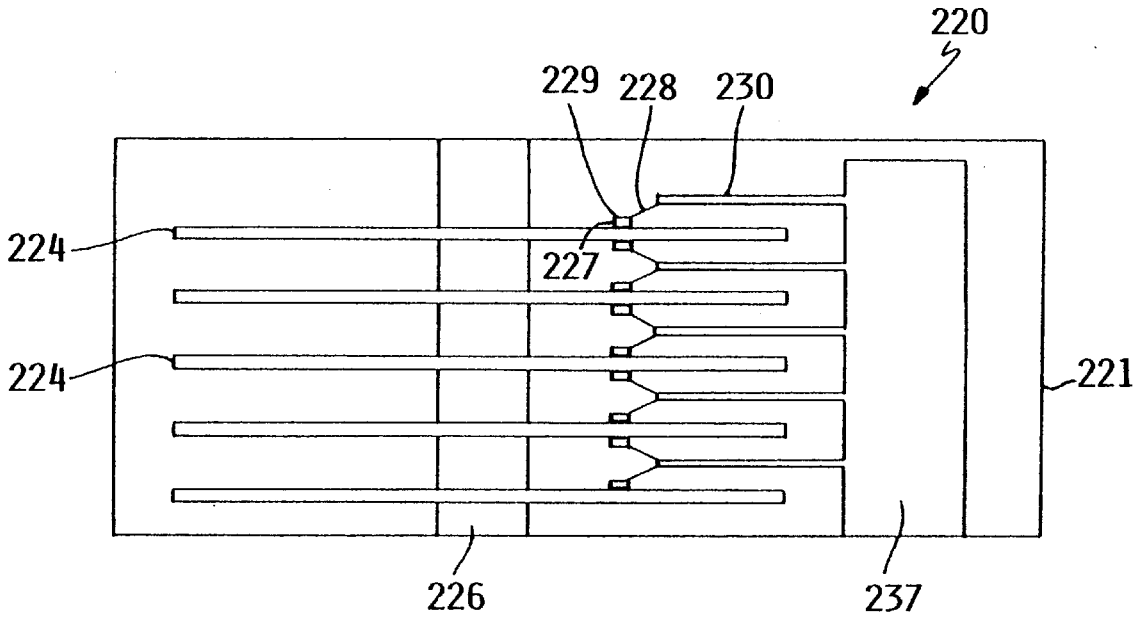
FIG. 14 is a side elevation view of a data storage system comprising a plurality of data storage disks having an annular disk substrate made according to an embodiment of the present invention.

A storage disk for use in a data storage device may be provided by applying a recording layer over the annular disk substrate 200 (shown in FIGS. 11 and 12). Referring now to FIG. 13, there is shown a magnetic data storage system 220 with its cover (not shown) removed from the base 222 of the housing 221. As best seen in FIG. 14, the magnetic data storage system 220 includes one or more rigid data storage disks 224 that are rotated by a spindle motor 226. The rigid data storage disks 224 are constructed with the annular disk substrate upon which a recording layer is formed. In one exemplary construction, a magnetizable recording layer is formed on an annular ceramic or glass disk substrate. In another exemplary construction, an aluminum optical recording layer is formed on an annular plastic disk substrate.

Referring back to FIG. 13, an actuator assembly 237 typically includes a plurality of interleaved actuator arms 230, with each arm having one or more suspensions 228 and transducers 227 mounted on airbearing sliders 229. The transducers 227 typically include components both for reading and writing information to and from the data storage disks 224. Each transducer 227 may be, for example, a magnetoresistive (MR) head having a write element and a MR read element. Alternatively, each transducer may be an inductive head having a combined read/write element or separate read and write elements, or an optical head having separate or combined read and write elements. The actuator assembly 237 includes a coil assembly 236 which cooperates with a permanent magnet structure 238 to operate as an actuator voice coil motor (VCM) 239 responsive to control signals produced by controller 258. The controller 258 preferably includes control circuitry that coordinates the transfer of data to and from the data storage disks 224, and cooperates with the VCM 239 to move the actuator arms 230 and suspensions 228, to position transducers 227 to prescribed track 250 and sector 252 locations when reading and writing data from and to the disks 224.

Working & Comparison Examples

Using a Jet Edge Model 55 30 horsepower intensifier pump and water jet head, an aluminosilicate glass sheet having a thickness of 1.02 mm was cut to form an annular disk substrate having a diameter of 95 mm. The glass sheet was supported on a support assembly having three support members, i.e., a peripheral support member, an annular support member and a hole support member, each having a separate support surface. A vacuum was used to hold the glass sheet in place, i.e., the support surface of the annular support member had a resilient cover member with a vacuum distribution trough evacuated through a vacuum port. The support assembly was resting in a catch tank that was approximately 30 inches in depth, height and length. The water jet head was supplied with an abrasive slurry from a slurry tank and water from the intensifier pump. The water was supplied from the intensifier pump at pressures ranging from approximately 8,000–55,000 psi, and at flow rates ranging from approximately 0.9–1.9 liters/min, depending on the pressure. The orifice diameter was 0.010 inches and the nozzle diameter was 0.060 inches. Typically, a smaller nozzle diameter of 0.030 inches is used in combination with an orifice diameter of 0.010 inches, but the smaller nozzle diameter appeared to stress the system. Intermediate nozzle diameters (e.g., 0.045 inches) were also acceptable. The nozzle standoff distance was about 1–3 mm.

The abrasive slurry was formed by mixing:

water=1700 ml deionized water, abrasive particles=750 g Barton Garnet (W6) having a nominal particle diameter of approximately 12 microns, surfactants/acid or base=7.5 g propylene glycol, 1.0 g Brij 30 (available from ICI Americas Inc. Corporation), 7.2 g 35% 250,000 MW polyacrylic acid, and 50 ml 85% phosphoric acid.

The flow of the abrasive slurry to the water jet head was approximately 125 ml/min (with the water supplied from the intensifier pump was at about 30,000 psi). A peristaltic type slurry pump was used to meter the flow of the abrasive slurry. The abrasive slurry was constantly stirred with a rotating blade stirrer near the bottom of the slurry tank. The abrasive slurry was drawn through a slurry line from a location near the bottom of the slurry tank. With the water supplied from the intensifier pump at a pressure of approximately 10,000 psi, pierce holes were formed in the glass sheet. After the pierce holes were formed, the pressure of the water supplied from the intensifier pump was increased to about 30,000 psi to cut the glass sheet at a rate of 0.416 mm/sec (±10%) and thereby form the annular disk substrate. The edge of the annular disk substrate was examined under a SEM and was found to have good surface finish. Notably, no "chipout" was observed on the bottom side to the edge of the annular disk substrate.

The surface finish of the edge of the annular disk substrate may be further improved by substituting relatively small diameter cerium oxide particles for a portion of the garnet particles in the abrasive slurry. For example, 550 g of cerium oxide particles having a nominal particle diameter of 3 microns and 200 g of the Barton Garnet (W6) having a nominal particle diameter of approximately 12 microns may be added to the abrasive slurry, in lieu of the 750 g Barton Garnet (W6) in the above example.

A comparison example was also run. The abrasive slurry in the comparison example was identical to that in the first example above, except for the absence of the surfactants and the acid or base. The absence of the acid or base and the surfactants in the abrasive slurry required the pressure of the water supplied from the intensifier pump to be increased from 20,000 psi to 50,000 psi. The edge of the resulting annular disk was examined under the SEM, and was found to have a rougher, longer order surface finish than the first example above.

Additional Examples

Additional examples were run using various compositions of abrasive slurry to form annular disk substrates each having a diameter of 95 mm. The aluminosilicate glass sheet (thickness of 1.02 mm), equipment and parameters used in Examples A–S that follow were the same as those used in the working example above, except where noted below. (Other examples were successfully run using like compositions of abrasive slurry to form annular disk substrates having diameters as small as 27 mm from aluminosilicate glass sheets having thicknesses as small as 0.3 mm.) The orifice diameter was again 0.010 inches, but the nozzle diameter was 0.040 inches. The volume flow rate of the abrasive slurry to the water jet head was approximately 5.5 ml/sec., the pressure of the water supplied from the intensifier pump was about 20,000 psi, and the linear velocity of the water jet head (i.e., cutting rate) was approximately 0.4 mm/sec. These parameters were chosen because of the axiom that the minimum energy required to achieve material separation will also result in the maximum quality of surface edge finish. Similarly, the smaller the abrasive particle size, the smoother the edge surface and the smaller the "chipout" at the edge bottom. However, the smaller the abrasive size, the longer it takes to cut through the material. Consequently, 12 micron garnet was selected as the abrasive particle. The water pressure of about 20,000 psi provided a sample annular disk substrate for every example except Example A (the reference, from which a sample annular disk substrate could not be formed due to breakage of the sheet). The cutting rate of approximately 0.4 mn/sec. was the equipment minimum. The abrasive slurry flow rate of approximately 5.5 ml/sec. was chosen so that plenty of abrasive slurry would be delivered to the mixing chamber of the water jet head. Non-uniformity in the supply of the abrasive slurry will create chips and cause the glass sheet to break.

| Example/ Type | Abrasive/ DI Water | Surfactant/ Acid or Base | Adjustment pH/ Measured pH |
|---|---|---|---|
| A/ Reference | 750 g 12 micron garnet/ 1700 ml | None/ None | Not Applicable/ 8.9 |
| B/ Surface Tension Reduction Only | 750 g 12 micron garnet/ 1700 ml | 7.5 g Propylene glycol (0.3%)/ None | Not Applicable/ 9.56 |
| C/ Surface Tension Reduction Only | 750 g 12 micron garnet/ 1700 ml | 7.5 g Neodol 1-9 (0.3%)/ None | Not Applicable/ 9.46 |
| D/ Surface Tension Reduction Only | 75 g 12 micron garnet/ 1700 ml | 7.5 g Brij 30 (0.3%)/ None | Not Applicable/ 9.33 |
| E/ Polish | 625 g 12 micron garnet & 150 g 2 micron Ferro 524 (cerium oxide)/ 1700 ml | 7.5 g Propylene glycol (0.3%)/ None | Not Applicable/ 8.71 |
| F/ Polish | 750 g 12 micron garnet & 100 cc 0.5 micron GE diamond slurry/ 1700 ml | 7.5 g Propylene glycol (0.3%)/ None | Not Applicable/ 9.72 |
| G/ Flocculated | 750 g 12 micron garnet/ 1700 ml | 7.5 g Propylene glycol (0.3%) & 0.20 g CorAdd 9192LF (0.08 vol %)/ 30 ml 70% $HNO_3$ | 1.0/ 1.04 |
| H/ | 750 g 12 micron garnet/ | 7.5 g Propylene glycol (0.3%) & | 1.0/ |

-continued

| Example/ Type | Abrasive/ DI Water | Surfactant/ Acid or Base | Adjustment pH/ Measured pH |
|---|---|---|---|
| Dispersed | 1700 ml | 0.20 g CorAdd 9195 (0.08 vol %)/ 30 ml 70% $HNO_3$ | 1.21 |
| I/ Dispersed, Base vs Acid | 750 g 12 micron garnet/ 1700 ml | 7.5 g Propylene glycol (0.3%) & 0.20 g CorAdd 9195 (0.08 vol %)/ 11 g KOH | 13.0/ 13.1 |
| J/ Acid Type | 750 g 12 micron garnet/ 1700 ml | 7.5 g Propylene glycol (0.3%)/ 50 ml $H_3PO_4$ | 1.0/ 1.38 |
| K/ Acid Type | 750 g 12 micron garnet/ 1700 ml | 7.5 g Propylene glycol (0.3%)/ 30 ml $HNO_3$ | 1.0/ 0.92 |
| L/ Acid Type | 750 g 12 micron garnet/ 1700 ml | 7.5 g Propylene glycol (0.3%)/ 30.0 g $H_3NSO_3$ (Sulfamic) | 1.0/ 1.58 |
| M/ Base Type | 750 g 12 micron garnet/ 1700 ml | 7.5 g Propylene glycol (0.3%)/ 11.5 g KOH | 13.0/ 13.18 |
| N/ Base Type | 750 g 12 micron garnet/ 1700 ml | 7.5 g Propylene glycol (0.3%)/ 12.0 g NaOH | 13.0/ 13.17 |
| O/ Strong Base Type | 750 g 12 micron garnet/ 1700 ml | 7.5 g Propylene glycol (0.3%)/ 112.0 g KOH (2N) | 2N/ 2N - pH meas. not possible |
| P/ Strong Base Type | 750 g 12 micron garnet/ 1700 ml | 7.5 g Propylene glycol (0.3%)/ 80.0 g NaOH (2N) | 2N/ 2N - pH meas. not possible |
| Q/ Dispersed | 750 g 12 micron garnet/ 1700 ml | 7.5 g Propylene glycol (0.3%)/ 5.0 g 2000 MW polyacrylic acid (0.1%) | Not Applicable/ 5.54 |
| R/ Flocculated | 750 g 12 micron garnet/ 1700 ml | 7.5 g Propylene glycol (0.3%)/ 10.0 g 50,000 MW polyacrylic acid (0.1%) | Not Applicable/ 6.41 |
| S/ Dispersed, Base vs Acid | 750 g 12 micron garnet/ 1700 ml | 7.5 g Propylene glycol (0.3%)/ 5.0 g 2000 MW polyacrylic acid (0.1%) & 14.8 g KOH | 13.0/ 13.19 |

For Examples B–S, the edge of the annular disk substrate was examined under a SEM. Example A (the reference) was not examined under SEM because, as discussed below, no sample annular disk substrate could be produced. Conclusions below with regard to surface finish are based on the SEM examinations.

Discussion of Examples A–D

Clearly, reducing the surface tension of the abrasive slurry is an enabler in cutting brittle materials with a small abrasive particle. This is shown by the inability to produce a sample annular disk substrate in Example A (Reference) due to the part shattering, while no such extreme difficulty was observed in Examples B–D (Surface Tension Reduction Only). Without the surface tension reducing agent, it is impossible to cut glass using the parameters stated above. Of the surface tension reducing agents tested, Brij 30 (Example D) resulted in the best surface with reduced bottom edge chipout, followed by Neodol 1–9 (Example C), and propylene glycol (Example B). However, at least at 0.3% volume, the Brij 30 in the abrasive slurry of Example D had the most foaming, while propylene glycol in the abrasive slurry of Example B had none. Also the abrasive slurry of Example D (Brij 30) lasted a long time as compared to the abrasive slurries of Examples B–C.

Discussion of Examples E–F

For CMCP (chemical mechanical cut and polish), Example E with its 12 micron garnet and 2 micron cerium oxide abrasive combination provided a better surface finish than Example B. Example F, which contained 12 micron garnet and 0.5 micron diamond, was clearly better than Example E and Example B. The smaller the particle to last touch the surface the better the quality (smoother) that particular location will be. However, a priori conditions/statistics dictate that in some locations the last particle to touch the surface will be the larger abrasive particle rather than the small polishing particle, thus resulting in a larger fracture and/or chip at that spot.

Discussion of Examples G–I

The only apparent difference for CMCP between flocculated (Example G) and dispersed (Example H) abrasive particles is that flocculated (Example G) shows less bottom chipout. This is significant when it comes to structural integrity of the annular disk substrate. It may be possible to conclude, however, that in certain circumstances dispersed abrasive slurry leaves a better surface finish than flocculated abrasive slurry. Having abrasive particles dispersed in a basic solution (Example I) rather than an acidic solution (Example H) results in a slightly smoother surface. In all cases (both acidic and basic solutions), either flocculated or dispersed is better than not chemically altering the slurry at all (Examples G–I are better than Example B). There were difficulties obtaining a sample annular disk substrate for Example I because the part kept breaking instead of cutting.

Discussion of Examples J–K

It is clear for CMCP that altering the slurry to be acidic can play a role in the resulting surface. The phosphoric acid $H_3PO_4$ in the abrasive slurry of Example J provided the best uniformity and quality. However, uniformity and quality of Example J is closely followed that provided by the nitric acid $HNO_3$ and the sulfamic acid $H_3NSO_3$ in the abrasive slurries respectively in Examples K and L.

Discussion of Examples M–P

It is clear for CMCP that altering the slurry to be caustic (basic) can pay a role in the resulting surface quality. There appears to be little difference between potassium hydroxide KOH and sodium hydroxide NaOH. The NaOH in the abrasive slurry of Example N is perhaps better in providing uniformity and smoothness as compared to the KOH in the abrasive slurry of Example M. The strong bases (i.e., 2 Normal) pH in Examples O and P appear to provide rougher surface finishes than their counterparts in Examples M and N. The strong NaOH in the abrasive slurry of Example P provided the roughest surface finish of the group. The NaOH in Examples N and P provided a surface finish void of chipout, while the KOH in Examples M and O provides a surface finish having very minor chipout. Since caustic solution etches and dissolves the glass, it is possible that increasing the linear velocity of the water jet head could improve the surface finish as the glass surface will spend less time in contact with the cutting stream. Also, NaOH is more aggressive on the glass surface than KOH. Perhaps LiOH could do even better.

Discussion of Examples Q–S

For CMCP, the question of which is better, flocculated or dispersed abrasive particles, is answered in Examples Q–S. Clearly, the flocculated abrasive particles in the abrasive slurry of Example R is better in providing uniformity and smoothness and avoiding chipout as compared to the dispersed abrasive particles in the abrasive slurry of Example Q. However, when a dispersed abrasive slurry is altered to a basic solution as in Example S, the surface finish approaches that of the acidic flocculated abrasive slurry in Example R. In all cases, chemically altering the slurry yields a better surface finish than Example A. In all cases, chemically altering the slurry beyond limited surface tension reduction yields a better surface finish than Example B.

Summary of SEM Analysis Results for Examples A–S

| Conclusion from CMCP Experiment | Supporting Results, Better Surface > Poorer Surface |
|---|---|
| Reduced surface tension enables and enhances cutting/polishing for both surface and edge chipout quality. Magnitude of enhancement correlates with degree of surface tension reduction: HLB (Hydrophile-Lipophile Balance) 9.7 (Brij 30) > HLB 13.9 (Neodol 1-9) > HLB 16 (propylene glycol) > HLB 39 (water only). | Example D > Example C > Example B > Example A. (0.3% Brij 30 > 0.3% Neodol 1-9 > 0.3% propylene glycol > water only.) With only water and 12 micron garnet at 20 psi the glass would not cut, only fractured into pieces. |
| Smaller and/or other abrasives types including mixtures enhance the surface and edge chipout quality. | Example F > Example E > Example B. (12 micron garnet & 0.5 micron diamond > 12 micron garnet & 2 micron cerium oxide > 12 micron garnet.) |
| Flocculated acidic slurries produce less chipout versus dispersed acidic slurries with the same (molecular weigh being the only difference) or similar additives and can also give better surface quality. Surfactant/polymer type makes a difference. | Example R > Example Q > Examples G & H. (50,000 MW polyacrylic acid > 2000 MW polyacrylic acid > CorAdd 9192LF ≧ CorAdd 9195.) |
| Surface quality is affected by acid type or anions present in acidic solution. | Example J > Examples K & L. (pH 1.0 phosphoric acid > pH 1.0 nitric acid ≧ pH 1.0 sulfamic acid. |
| Basic slurries produce edges with less than or equal chipout versus acidic slurries with the same or similar ions, surfactants, or polymers. | [Example N > Example J] > [Example S > Example Q] > Examples H & I. ([pH 13.0 NaOH > pH 1.0 $H_3PO_4$] > [pH 13.0 2000 MW polyacrylic acid > pH 6.41 2000 MW polyacrylic acid] > pH 1.0 CorAdd 9195 = pH 13.0 CorAdd 9195.) |
| Increasing base strength increases surface roughness, indicating potential for increased cutting rate, i.e., there is an optimum base strength for a given cutting rate. | Example N > Example M > Examples P & O. (pH 13.0 NaOH > pH 13.0 KOH > 2N NaOH & 2N KOH.) |

While this invention has been described with respect to the preferred and alternative embodiments, it will be understood by those skilled in the art that various changes in detail may be made therein without departing from the spirit, scope, and teaching of the invention. For example, the invention may be utilized in applications other than data storage medium applications. Accordingly, the herein disclosed invention is to be limited only as specified in the following claims.

What is claimed is:

1. A fluid jet cutting apparatus for cutting an annular disk substrate from a sheet, comprising:

a fluid jet head for directing a fluid jet stream against the sheet from which the disk substrate is to be cut by the fluid jet stream, the head being adapted to follow an outside edge path along the sheet to form an outside edge of the disk substrate and an inside edge path along the sheet to form an inside edge of the disk substrate, the sheet comprising a peripheral portion lying outwardly of the outside edge path, an annular portion lying between the outside edge path and the inside edge path, and a hole portion lying inwardly of the inside edge path;

a first support member having a central opening therein generally similar to and larger than the outside edge of the disk substrate and including a support surface for supporting the peripheral portion of the sheet;

a second support member having a central opening therein generally similar to and larger than the inside edge of the disk substrate and including a support surface positioned inside the central opening of the first support member for supporting the annular portion of the sheet, the second support member comprising a vacuum port for pulling the annular portion of the sheet against the support surface of the second support member; and a third support member including a support surface positioned inside the central opening of the second support member for supporting the hole portion of the sheet.

2. The fluid jet cutting apparatus as recited in claim 1, wherein the first support member includes a plurality of the central openings and the fluid cutting apparatus further comprises a plurality of the second and third support members, whereby a plurality of annular disk substrates are cut from the sheet.

3. The fluid jet cutting apparatus as recited in claim 2, wherein the central openings in the first support member are arranged in nested rows each having a plurality of the central openings.

4. The fluid jet cutting apparatus as recited in claim 3, wherein the first support member has an edge that is scalloped in accordance with the arrangement of adjacent central openings for matingly receiving a correspondingly scalloped edge of an additional first support member.

5. The fluid jet cutting apparatus as recited in claim 2, wherein the first support member has more than 25 central openings, whereby more than 25 annular disk substrates having a diameter of approximately 95 mm are cut from a portion of the sheet that is approximately 610 mm wide and approximately 610 mm long.

6. The fluid jet cutting apparatus as recited in claim 5, wherein the first support member has 27 central openings, whereby 27 annular disk substrates having a diameter of approximately 95 mm are cut from the portion of the sheet that is approximately 610 mm wide and approximately 610 mm long.

7. The fluid jet cutting apparatus as recited in claim 2, wherein the first support member has more than 70 central openings, whereby more than 70 annular disk substrates having a diameter of approximately 95 mm are cut from a portion of the sheet that is approximately 1160 mm wide and approximately 845 mm long.

8. The fluid jet cutting apparatus as recited in claim 7, wherein the first support member has 80 central openings, whereby 80 annular disk substrates having a diameter of approximately 95 mm are cut from the portion of the sheet that is approximately 1160 mm wide and approximately 845 mm long.

9. The fluid jet cutting apparatus as recited in claim 2, wherein the first support member has more than 88 central openings, whereby more than 88 annular disk substrates having a diameter of approximately 95 mm are cut from a portion of the sheet that is approximately 1250 mm wide and approximately 895 mm long.

10. The fluid jet cutting apparatus as recited in claim 9, wherein the first support member has 110 central openings, whereby 110 annular disk substrates having a diameter of approximately 95 mm are cut from the portion of the sheet that is approximately 1250 mm wide and approximately 895 mm long.

11. The fluid jet cutting apparatus as recited in claim 1, wherein at least one of the first support member and third support member comprises a vacuum port for respectively pulling the peripheral portion of the sheet against the support surface of the first support member and pulling the hole portion of the sheet against the support surface of the third support member.

12. A fluid jet cutting apparatus for cutting an object from a sheet, the object having a hole therein, comprising:

a fluid jet head for directing a fluid jet stream against the sheet from which the object is to be cut by the fluid jet stream, the head being adapted to follow an outside edge path along the sheet to form an outside edge of the object and an inside edge path along the sheet to form an inside edge of the object that defines the hole, the sheet comprising a peripheral portion lying outwardly of the outside edge path, an object portion lying between the outside edge path and the inside edge path, and a hole portion lying inwardly of the inside edge path;

a first support member having a central opening therein generally similar to and larger than the outside edge of the object and including a support surface for supporting the peripheral portion of the sheet;

a second support member having a central opening therein generally similar to and larger than the inside edge of the object and including a support surface positioned inside the central opening of the first support member for supporting the object portion of the sheet, the second support member comprising a vacuum port for pulling the object portion of the sheet against the support surface of the second support member; and a third support member including a support surface positioned inside the central opening of the second support member for supporting the hole portion of the sheet.

13. A method for cutting an annular disk substrate from a sheet using a fluid jet cutting apparatus, comprising the steps of:

supporting a peripheral portion of the sheet on a support surface of a first support member, the first support member having a central opening therein generally similar to and larger than an outside edge of the disk substrate to be cut from the sheet;

supporting an annular portion of the sheet on a support surface of a second support member positioned inside the central opening of the first support member, the second support member having a central opening therein generally similar to and larger than an inside edge of the disk substrate to be cut from the sheet;

supporting a hole portion of the sheet on a support surface of a third support member positioned inside the central opening of the second support member;

pulling the annular portion of the sheet against the support surface of the second support member using a vacuum port in the second support member; and directing a fluid jet stream against the sheet using a fluid jet head adapted to follow an outside edge path along the sheet to form the outside edge of the disk substrate and an inside edge path along the sheet to form the inside edge of the disk substrate, wherein the peripheral portion of the sheet lies outwardly of the outside edge path, the annular portion of the sheet lies between the outside edge path and the inside edge path, and the hole portion of the sheet lies inwardly of the inside edge path.

14. The method as recited in claim 13, wherein the sheet is glass.

15. The method as recited in claim 13, wherein the sheet is ceramic.

16. A method for cutting an object having a hole from a sheet using a fluid jet cutting apparatus, comprising the steps of:

supporting a peripheral portion of the sheet on a support surface of a first support member, the first support member having a central opening therein generally similar to and larger than an outside edge of the object to be cut from the sheet;

supporting an object portion of the sheet on a support surface of a second support member positioned inside the central opening of the first support member, the second support member having a central opening therein generally similar to and larger than an inside edge of the object to be cut from the sheet;

supporting a hole portion of the sheet on a support surface of a third support member positioned inside the central opening of the second support member;

pulling the object portion of the sheet against the support surface of the second support member using a vacuum port in the second support member; and directing a fluid jet stream against the sheet using a fluid jet head adapted to follow an outside edge path along the sheet to form the outside edge of the object and an inside edge path along the sheet to form the inside edge of the object, wherein the peripheral portion of the sheet lies outwardly of the outside edge path, the object portion of the sheet lies between the outside edge path and the inside edge path, and the hole portion of the sheet lies inwardly of the inside edge path.

17. A fluid jet cutting apparatus for cutting a plurality of disk substrates from a sheet, wherein the sheet is selectable from a first size and a second size, the second size being larger than the first size, comprising:

a fluid jet head for directing a fluid jet stream against the sheet from which the disk substrates are to be cut by the fluid jet stream, the head being adapted to follow a path along the sheet to form an outside edge of each of the disk substrates;

a support member having a plurality of central openings therein generally similar to and larger than the outside edge of each of the disk substrates and including a support surface for supporting a portion of the sheet, the central openings in the support member are arranged in nested rows each having a plurality of the central openings, wherein the support member has an edge that is scalloped in accordance with the arrangement of adjacent central openings for matingly receiving a correspondingly scalloped edge of an additional support member, whereby the support member accommodates the sheet having the first size and the support member in combination with the additional support member accommodates the sheet having the second size.

18. The fluid jet cutting apparatus as recited in claim 17, wherein the support member has a plurality of edges each scalloped in accordance with the arrangement of adjacent central openings for matingly receiving a correspondingly scalloped edge of another support member.

19. A fluid jet cutting apparatus for cutting a plurality of objects from a sheet, wherein the sheet is selectable from a first size and a second size, the second size being larger than the first size, comprising:

a fluid jet head for directing a fluid jet stream against the sheet from which the objects are to be cut by the fluid jet stream, the head being adapted to follow a path along the sheet to form an outside edge of each of the objects;

a support member having a plurality of central openings therein generally similar to and larger than the outside edge of each of the objects and including a support surface for supporting a portion of the sheet, the central openings in the support member are arranged in nested rows each having a plurality of the central openings, wherein the support member has an edge that is scalloped in accordance with the arrangement of adjacent central openings for matingly receiving a correspondingly scalloped edge of an additional support member, whereby the support member accommodates the sheet having the first size and the support member in combination with the additional support member accommodates the sheet having the second size.

20. A method for cutting a plurality of disk substrates from a sheet using a fluid jet cutting apparatus, wherein the sheet is selectable from a first size and a second size, the second size being larger than the first size, comprising the steps of:

providing a support member having a plurality of central openings therein generally similar to and larger than an outside edge of each of the disk substrates to be cut from the sheet and including a support surface for supporting a portion of the sheet, the central openings in the support member are arranged in nested rows each having a plurality of the central openings, wherein the support member has an edge that is scalloped in accordance with the arrangement of adjacent central openings for matingly receiving a correspondingly scalloped edge of an additional support member;

if the sheet having the first size is selected, supporting the sheet on the support member;

if the sheet having the second size is selected, providing the additional support member, positioning the scalloped edge of the additional support member in a mating relationship with the scalloped edge of the support member, and supporting the sheet on the support member and the additional support member; and directing a fluid jet stream against the sheet using a fluid jet head adapted to follow a path along the sheet to form the outside edge of each of the disk substrates.

21. The method as recited in claim 20, wherein the sheet is glass.

22. The method as recited in claim 20, wherein the sheet is ceramic.

23. A method for cutting a plurality of objects from a sheet using a fluid jet cutting apparatus, wherein the sheet is selectable from a first size and a second size, the second size being larger than the first size, comprising the steps of:

providing a support member having a plurality of central openings therein generally similar to and larger than an outside edge of each of the objects to be cut from the sheet and including a support surface for supporting a portion of the sheet, the central openings in the support member are arranged in nested rows each having a plurality of the central openings, wherein the support member has an edge that is scalloped in accordance with the arrangement of adjacent central openings for matingly receiving a correspondingly scalloped edge of an additional support member;

if the sheet having the first size is selected, supporting the sheet on the support member;

if the sheet having the second size is selected, providing the additional support member, positioning the scalloped edge of the additional support member in a mating relationship with the scalloped edge of the support member, and supporting the sheet on the support member and the additional support member; and directing a fluid jet stream against the sheet using a fluid jet head adapted to follow a path along the sheet to form the outside edge of each of the objects.

24. A method for cutting a plurality of disk substrates from a sheet using a fluid jet cutting apparatus, comprising the steps of:

providing a support member having at least one central opening therein generally similar to and larger than an outside edge of the disk substrates to be cut from the sheet and including a support surface for supporting a portion of the sheet;

adhering a plurality of layers to one another in a stacked relationship to form the sheet;

supporting the sheet on the support member;

cutting through each of the layers of the sheet by directing a fluid jet stream against the sheet using a fluid jet head adapted to follow a path along the sheet to form the outside edge of the disk substrates; and separating the disk substrates from one another.

25. The method as recited in claim 24, wherein the layers are glass.

26. The method as recited in claim 24, wherein the layers are ceramic.

27. The method as recited in claim 24, wherein the cutting step comprises the step using a plurality of fluid jet heads to cut through the sheet at multiple locations by simultaneously directing a plurality of fluid jet streams against the sheet, each of the fluid jet heads being adapted to follow a path along the sheet to form the outside edge of the disk substrates.

28. The method as recited in claim 24, wherein the adhering step comprises the step of adhering the layers to one another using the surface tension of water.

29. The method as recited in claim 24, wherein the adhering step comprises the step of adhering the layers to one another using an adhesive.

30. The method as recited in claim 29, wherein the layers are each covered with a protection layer.

31. The method as recited in claim 30, wherein the protection layer is a plastic layer.

32. The method as recited in claim 30, wherein the protection layer is a paper layer.

33. A method for cutting a plurality of objects from a sheet using a fluid jet cutting apparatus, comprising the steps of:

providing a support member having at least one central opening therein generally similar to and larger than an outside edge of the objects to be cut from the sheet and including a support surface for supporting a portion of the sheet;

adhering a plurality of layers to one another in a stacked relationship to form the sheet;

supporting the sheet on the support member;

cutting through each of the layers of the sheet by directing a fluid jet stream against the sheet using a fluid jet head adapted to follow a path along the sheet to form the outside edge of the objects; and separating the objects from one another.

34. A method for cutting a disk substrate from a sheet using a fluid jet cutting apparatus, comprising the steps of:

providing a sheet comprising a substrate layer and a protective layer covering a portion of at least one surface of the substrate layer;

providing a support member having at least one central opening therein generally similar to and larger than an outside edge of the disk substrate to be cut from the sheet and including a support surface for supporting a portion of the sheet;

supporting the sheet on the support member;

cutting through the sheet by directing a fluid jet stream against the sheet using a fluid jet head adapted to follow a path along the sheet to form the outside edge of the disk substrate; and removing the protective layer from the substrate layer after forming the outside edge of the disk substrate.

35. The method as recited in claim 34, wherein the substrate layer is glass.

36. The method as recited in claim 34, wherein the substrate layer is ceramic.

37. The method as recited in claim 34, wherein the protection layer is a plastic layer.

38. The method as recited in claim 37, wherein the plastic layer is adhered to the substrate layer by static adhesion.

39. The method as recited in claim 37, wherein the plastic layer is adhered to the substrate layer by an adhesive.

40. The method as recited in claim 34, wherein the protection layer is a paper layer.

41. A method for cutting an object from a sheet using a fluid jet cutting apparatus, comprising the steps of:

providing a sheet comprising an object layer and a protective layer covering a portion of at least one surface of the object layer;

providing a support member having at least one central opening therein generally similar to and larger than an outside edge of the object to be cut from the sheet and including a support surface for supporting a portion of the sheet;

supporting the sheet on the support member;

cutting through the sheet by directing a fluid jet stream against the sheet using a fluid jet head adapted to follow a path along the sheet to form the outside edge of the object; and removing the protective layer from the object layer after forming the outside edge of the object.

* * * * *